US005242788A

United States Patent [19]

Takahashi et al.

[11] Patent Number: 5,242,788

[45] Date of Patent: Sep. 7, 1993

[54] SILVER HALIDE COLOR PHOTOSENSITIVE MATERIALS

[75] Inventors: Osamu Takahashi; Tadahisa Sato, both of Kanagawa, Japan

[73] Assignee: Fuji Photo Film Co., Ltd., Kanagawa, Japan

[21] Appl. No.: 859,982

[22] Filed: Mar. 30, 1992

Related U.S. Application Data

[63] Continuation-in-part of Ser. No. 296,174, Jan. 12, 1989, abandoned.

[30] Foreign Application Priority Data

Jan. 12, 1988 [JP] Japan ..... 63-003171

[51] Int. Cl.[5] ..... G03C 7/38

[52] U.S. Cl. ..... 430/558; 430/543; 430/545; 430/546; 430/551; 430/554; 430/567; 430/634

[58] Field of Search ..... 430/551, 558, 554, 543, 430/546, 545, 634, 567

[56] References Cited

U.S. PATENT DOCUMENTS 4,741,995 5/1988 Tani et al. ..... 430/558

FOREIGN PATENT DOCUMENTS 53-001521 1/1978 Japan ..... 430/634

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

Color photographs of which the colored image has improved storage stability, which have a good overall cyan, magenta and yellow image color balance even after long term storage, and with which, moreover, little staining of the white base occurs, are obtained by means of this invention.

10 Claims, No Drawings

SILVER HALIDE COLOR PHOTOSENSITIVE MATERIALS

CROSS REFERENCE TO RELATED APPLICATION

This application in a continuation-in-part of application Ser. No. 07/296,174, filed Jan. 12, 1989, now abandoned.

FIELD OF THE INVENTION

This invention concerns silver halide photographic materials which have excellent storage properties and, more precisely, the invention concerns silver halide color photographic materials of which the stability of the colored image with respect to light and heat during the storage of a color photograph is increased, and with which there is less coloration of the base (so-called staining) due to degradation of organic materials which have been included in the photosensitive materials, developing agents which are left behind in the photosensitive material after processing, and compounds derived therefrom.

BACKGROUND OF THE INVENTION

The long term storage of silver halide color photographs in the same condition as that obtained immediately after development is very important when considering the possible use of photographs as records. A great deal of research effort has therefore been directed at this point. The stability of the dye images is an important factor in respect of the long term storage of color photographs.

The dye images of silver halide color photographic materials are known to fade markedly, depending on the storage conditions, when they are stored for a long period of time in light, and also when they are exposed to light for short periods of time and stored for long periods of time in the dark. In general, the color fading in the former case is called light fading and that in the latter cases is called dark fading, and when color photographic materials are stored semipermanently as records it is desirable that the extents of light fading and dark fading should be reduced to a minimum and that the overall color balance of the faded tricolor yellow, magenta and cyan dye images should be maintained in the initial state. However, the extents of light and dark fading differ for each of the yellow, magenta and cyan dye images, and after long term storage the aforementioned overall faded color balance is inevitably destroyed and the picture quality of the dye image inevitably deteriorates.

The extents of light fading and dark fading differ according to the couplers which are used and other factors but, in many cases, dark fading arises most readily in the case of the cyan dye image, followed in order by the yellow dye image and the magenta dye image, and the extent of the dark fading of the cyan dye image is greater than that of the other dye images. Furthermore, in the case of light fading, the magenta dye image tends to fade most readily when a visible light source is used, followed in order by the cyan dye image and the yellow dye image.

Thus, in order to maintain a good faded color balance between the yellow, magenta and cyan dye images over a long period of time it is necessary to reduce to a minimum the light and dark fading of the cyan dye image, and various attempts have been made in the past with a view to improving light and dark fading properties for this purpose. These past attempts can be broadly classified into two categories, namely those in which novel couplers which can form dye images which are less liable to fading have been developed and those in which novel additives which prevent fading from occurring have been developed.

The former of these methods have been widely researched (U.S. Pat. No. 2,801,171, JP-B-49-11572, U.S. Pat. No. 2,895,826, JP-A-55-163537 and JP-A-56-104333, U.S. Pat. Nos. 3,767,4125 and 4,03,716 and JP-B-48-30494, etc.) (the term "JP-A" as used herein signifies an unexamined published Japanese patent application, and the term "JP-B" as used herein signifies an examined published Japanese patent application), but not so many reports have been published in connection with the latter methods mentioned above, and as yet no effective method which can be used without some adverse effect has been discovered.

A second important point in respect of the long term storage of color photographs involves the prevention of coloration of the white background which is to say the prevention of the occurrence of staining due to light and heat. The occurrence of staining can be broadly classified as that which is caused by the degradation of organic materials which are present in the photosensitive material from the start and that which is due to development bath components, especially primary aromatic amine compounds which are the developing agents and compounds derived therefrom, which are left behind in the photosensitive material after development processing. This staining not only causes coloration of the white base but also has a further disadvantage in that it reduces the image saturation of a color photograph.

Silver halide color photographs reproduce a colored image with the three colors yellow, magenta and cyan but, of these, the hue of the magenta is of particular importance from the viewpoint of color reproduction. Progress has been made recently with the improvement of the magenta couplers which form the magenta dyes, and magenta couplers, such as the pyrazoloazole based couplers (U.S. Pat. No. 4,540,654, JP-A-61-65245, etc.), which have a sharp spectral absorption without the subsidiary absorption in the vicinity of 430 nm, which is a major disadvantage of the existing 5-pyrazolone based couplers (JP-A-49-74027, JP-A-49-111631, etc.), have been discovered and put to practical use. The color reproduction in a silver halide color photograph is greatly improved by using these couplers, but the occurrence of staining during storage has become an even greater problem that it was in the past.

Effective methods for preventing the occurrence of this staining have been proposed in U.S. Pat. Nos. 4,463,085 and 4,483,918, in JP-A-59-218445 and JP-A-59-229557 and in U.S. Pat. Nos. 4,358,525, 4,465,762, 4,522,917 and 4,661,440, etc., but as yet these have proved to be unsatisfactory as a means of preventing the occurrence of staining to a sufficiently high level.

SUMMARY OF THE INVENTION

Thus, the first aim of the invention is to provide silver halide color photographic materials with which sharp color photographs with which an excellent tricolor balance is maintained even on long term storage, and with which there is little deterioration of the colored image, can be obtained.

The second aim of the invention is to provide silver halide color photographic materials with which it is possible to obtain color photographs with which there is very little coloration of the white background even on long term storage.

As a result of thorough research, the inventors have discovered that the aforementioned aims can be realized in the way indicated below. Thus, the above mentioned aims can be realized by means of silver halide color photographic materials of which the distinguishing features are that, in a silver halide photographic material comprising a support having provided thereon a plurality of photographic constituting layers comprising a light-insensitive hydrophilic colloid layer and a cyan dye-forming coupler-containing silver halide emulsion layer, a magenta dye-forming coupler containing silver halide emulsion layer and a yellow dye-forming coupler-containing silver halide emulsion layer, wherein said magenta dye-forming coupler is represented by the formula (I) below, and a water insoluble but organic solvent soluble polymer is incorporated in at least one of said silver halide emulsion layers, and further an aliphatic ester solvent represented by the formula (II) or (III) below is incorporated in at least one of said light-insensitive hydrophilic colloid layer and said silver halide emulsion layers.

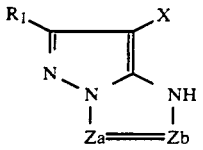
(I)

$R_2$—$(COOR_3)_m$ (II)

$(R_4COO)_n$—$R_5$ (III)

In these formulae, $R_1$ represents a hydrogen atom or a substituent group, and X represents a hydrogen atom or a group which can be eliminated during a coupling reaction with the oxidized form of a developing agent.

$Z_a$ and $Z_b$ represent =CH—,

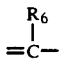

or =N—, and when the double bond $Z_a$=$Z_b$ is a carbon—carbon double bond, this double bond may form part of an aromatic ring $R_6$ represents a substituent group. Moreover, m and n represent integer values of from 2 to 5, and $R_2$ and $R_5$ represent alkylidene groups, alkylene groups, alkenylene groups, alkanetriyl groups, alkenetriyl groups, alkanetetrayl groups, alkenetetrayl groups, alkanepentayl groups or alkenepentayl groups $R_3$ and $R_4$ represent alkyl groups, alkenyl groups or alkynyl groups which have not more the 20 carbon atoms.

This invention is described in detail below.

The couplers of general formula (I) which can be represented by the general formulae (I-1), (I-2), (I-3), (I-4) and (I-5) are preferred.

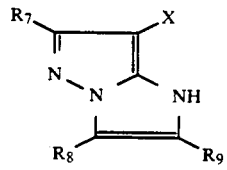
(I-1)

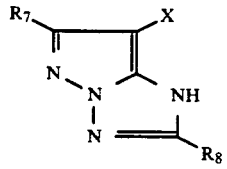
(I-2)

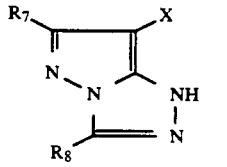
(I-3)

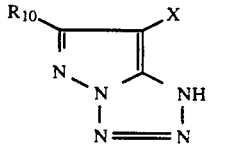
(I-4)

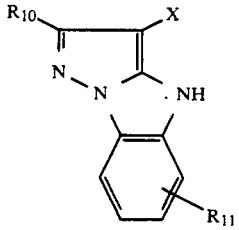
(I-5)

Those couplers which can be represented by the general formulae (I-1), (I-2) and (I-3) are preferred, and of these, those which can be represented by the general formula (I-2) are the most preferred.

The substituent groups in general formulae (I-1) to (I-5) are such that $R_7$, $R_8$, $R_9$, $R_{10}$ and $R_{11}$ represent hydrogen atoms, alkyl groups, aryl groups, heterocyclic groups, cyano groups, alkoxy groups, aryloxy groups, heterocyclic oxy groups, acyloxy groups, carbamoyloxy groups, silyloxy groups, sulfonyloxy groups, acylamino groups, anilino groups, ureido groups, imido groups, sulfamoylamino groups, carbamoylamino groups, alkylthio groups, arylthio groups, heterocyclic thio groups, alkoxycarbonylamino groups, aryloxycarbonylamino groups, sulfonamido groups, carbamoyl groups, acyl groups, sulfamoyl groups, sulfonyl groups, sulfinyl groups, alkoxycarbonyl groups or aryloxycarbonyl groups, but $R_7$ and $R_{10}$ are preferably alkyl groups, alkoxy groups or aryloxy groups and $R_8$ and $R_{11}$ are preferably alkyl groups, aryl groups, acylamino groups, alkylthio groups arylthio groups or sulfonamido groups.

X in general formulae (I-1) to (I-5) represents a hydrogen atom, halogen atom, carboxyl group or a group which is eliminated on coupling, being a group which is bonded to the carbon at the coupling position via an oxygen atom, nitrogen atom or sulfur atom, but it is preferably a halogen atom or a coupling leaving group which is bonded via a sulfur atom.

Bis forms obtained via divalent groups at $R_7$, $R_8$, $R_9$, $R_{10}$, $R_{11}$ or X are also included. Furthermore, the coupler may take a polymeric form, and when, in such a case, the parts represented by the general formulae (I-1) to (I-5) are included in a vinyl monomer, $R_7$, $R_8$, $R_9$, $R_{10}$ or $R_{11}$ represent a single bond or a linking group, and the vinyl group is bonded to the part represented by the general formula (I-1) to (I-5) via this group.

The atoms or groups which are typical of $R_7$ to $R_{11}$ are described in detail below.

The alkyl groups (moieties), aryl groups (moieties), and heterocyclic groups (moieties) among these groups include cases in which these groups are optionally substituted with substituent groups such as those listed as examples of $R_7$ to $R_{11}$, and the alkyl groups may be linear chain, branched or alicyclic alkyl groups.

Thus, the groups and atoms indicated below are included among the actual examples of the groups $R_7$ to $R_{11}$; hydrogen atom, halogen atoms (chlorine, bromine, etc.), alkyl groups (methyl, ethyl, propyl, iso-propyl, butyl, t-butyl, hexyl, cyclohexyl, trifluoromethyl, 2-arylsulfonamidoethyl, 1-arylsulfonamidoethyl, alkylsulfonylethyl, arylsulfonylethyl, tridecyl, 3-(2,4-ditert-amylphenoxy)propyl, 2-dodecyloxyethyl, 3-phenoxypropyl, cyclopentyl, benzyl, etc.), aryl groups (for example, phenyl, 4-tert-butylphenyl, 2,4-di-tert-amylphenyl, 4-tetradecanamidophenyl, 3,4-dichlorophenyl, etc.), heterocyclic groups (for example, 2-fuyl, 2-thienyl, 2-pyrimidinyl, 2-benzothiazolyl, etc.), a cyano group, alkoxy groups (for example, methoxy, ethoxy, 2-methoxyethoxy, 2-dodecyloxyethoxy, 2-methanesulfonylethoxy, 2-aryloxyethoxy, etc.), aryloxy groups (phenoxy, 2-methylphenoxy, 3-chlorophenoxy, 4-tert-butylphenoxy, etc.), heterocyclic oxy groups (2-benzimidazolyloxy, etc.), acyloxy groups (for example, acetoxy group, hexadecanoyloxy, etc.), carbamoyloxy groups (for example, N-phenylcarbamoyloxy, N-ethylcarbamoyloxy, etc.), silyloxy groups (for example, trimethylsilyloxy, etc.), sulfonyloxy groups (for example, dodecylsulfonyloxy, etc.), acylamino groups (for example, acetamido, benzamido, tetradecanamido, α-(2,4-di-tertamylphenoxy)butylamido, γ-(3-tert-butyl-4-hydroxyphenoxy)butylamido, α-[4-(4-hydroxyphenylsulfonyl)phenoxy]decanamido, etc.), anilino groups (for example, phenylamino, 2-chloroanilino, 2-chloro-5-tetradecanamidoanilino, 2-chloro-5-dodecyloxycarbonylanilino, N-acetylanilino, 2-chloro-5-(α-(3-tert-4-hydroxyphenoxy)dodecanamido)anilino, etc.), ureido groups (for example, phenylureido, methylureido, N,N-dibutylureido, etc.), imido groups (for example, N-succinimido, 3-benzylhydantoinyl, 4-(2-ethylhexanoylamino)phthalimido, etc.), sulfamoylamino groups (for example, N,N-dipropylsulfamoylamino, N-methyl-N-decylsulfamoylamino, etc.), alkylthio groups (for example, methylthio, octylthio, tetradecylthio, 2-phenoxyethylthio, 3-phenoxypropylthio, 3-(4-tert-butylphenoxy)propylthio, etc.), arylthio groups (for example, phenylthio, 2-butoxy-5-t-octylphenylthio, 3-pentadecylphenylthio, 2-carboxyphenylthio, 4-tetradecanamidophenylthio, etc.), heterocyclic thio groups (for example, 2-benzothiazolylthio, etc.), alkoxycarbonylamino groups (for example, methoxycarbonylamino, tetradecyloxycarbonylamino, etc.), aryloxycarbonylamino groups (for example. phenoxycarbonylamino, 2,4-di-tert-butylphenoxycarbonylamino, etc.), sulfonamido groups (for example, methanesulfonamido, hexadecanesulfonamido, benzenesulfonamido, p-toluenesulfonylamido, octadecanesulfonamido, 2-methyloxy-5-tert-butylbenzenesulfonamido, etc.), carbamoyl groups (for example, N-ethylcarbamoyl, N,N-dibutylcarbamoyl, N-(2-dodecyloxyethyl)carbamoyl, N-methyl-N-dodecylcarbamoyl, N-(3-(2,4-di-tert-amylphenoxy)propyl)carbamoyl, etc.), acyl groups (for example, acetyl, (2,4-di-tert-amylphenoxy)acetyl, benzoyl, etc.), sulfamoyl groups (for example, N-ethylsulfamoyl, N,N-dipropylsulfamoyl, N-(2-dodecyloxyethyl)sulfamoyl, N-ethyl-N-dodecylsulfamoyl, N,N-diethylsulfamoyl, etc.), sulfonyl groups (for example, methanesulfonyl, octanesulfonyl, benzenesulfonyl, toluenesulfonyl, etc.), sulfinyl groups (for example, octanesulfinyl, dodecylsulfinyl, phenylsulfinyl, etc.), alkoxycarbonyl groups (for example, methoxycarbonyl, butoxycarbonyl, dodecyloxycarbonyl, octadecyloxycarbonyl, 3-pentadecyloxycarbonyl, etc.), and aryloxycarbonyl groups (for example, phenyloxycarbonyl, 3-pentadecylphenyloxycarbonyl, etc.).

X is described in more detail below. Thus, X represents a hydrogen atom, a halogen atom (for example, chlorine, bromine, iodine, etc.), a carboxyl group, or a group which is linked via an oxygen atom (for example, acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy, etc.), a group which is bonded via a nitrogen atom (for example, benzenesulfonamido, N-ethyltoluenesulfonamido, heptafluorobutanamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzylethoxy-3-hydantoinyl, 2N-1,1-dioxo-3(2H)oxo-1,2-benzoisothiazolyl, 2-oxo-1,2-dihydro-1-pyridinyl, imidazolyl, pyrazolyl, 3,5-diethyl-1,2,4-triazol-1-yl 5- or 6-bromobenzotriazol-1-yl, 5-methyl-1,2,3,4-tetrazol-1-yl group, benzimidazolyl, 3-benzyl-1-hydantoinyl, 1-benzyl-5-hexadecyloxy-3-hydantoinyl, 5-methyl-1-tetrazolyl, 4-methoxyphenylazo, 4-pivalylaminophenylazo, 2-hydroxy-4-propanoylphenylazo, etc.), or a group which is bonded via a sulfur atom (for example, phenylthio, 2-carboxyphenylthio, 2-methoxy-5-tert-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazolyl-5-thio, etc.).

In cases where $R_7$, $R_8R_9$, $R_{10}$, $R_{11}$ or X are a divalent group and a dimer is formed, the divalent group is, more precisely, a substituted or unsubstituted alkylene group (for example, methylene, ethylene, 1-ethylethylene, 1,10-decylene, $—CH_2CH_2—O—CH_2CH_2—$, etc.), a substituted or unsubstituted phenylene group (for example, 1,4-phenylene, 1,3-phenylene,

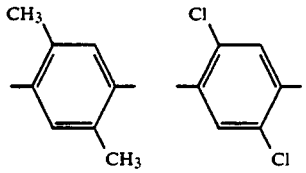

etc.), and —NHCO—$R_{12}$—CONH— group (where $R_{12}$ represents a substituted or unsubstituted alkylene group or phenylene group). Oligomers may also be formed at $R_7$, $R_8$, $R_9$, $R_{10}$, and $R_{11}$ and here the term "oligomer" includes those which have two or more groups comprising any of those of general formulae (I-1) to (I-5) within a single molecule, and it includes bis forms and polymeric couplers. Here, a polymeric coupler may be a homopolymer which has a part consisting only of monomers which can be represented by any one of the general formulae (I-1) to (I-5) (and preferably a monomer which has a vinyl group, referred to below as a vinyl monomer) or it may be a copolymer with a non-color forming ethylenic monomer which does not couple with the oxidation products of primary aromatic amine developing agents.

The linking groups represented by $R_7$, $R_8$, $R_9$, $R_{10}$, or $R_{11}$ in the case of a vinyl monomer which incorporates a unit which can be represented by general formula (I-1) to (I-5) is an alkylene group (which may be a substituted or unsubstituted alkylene group, for example, methylene, ethylene, 1-methylethylene, 1,10-dodecylene, —$CH_2CH_2$—O—$CH_2CH_2$, etc.), a phenylene group (a substituted or unsubstituted phenylene group, for example, 1,4-phenylene, 1,3-phenylene,

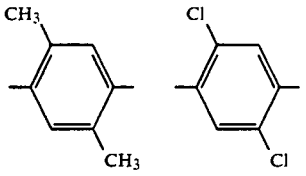

etc.) or a group which is made up of a combination of groups selected from among the —NHCO— group, —CONH— group, —O— group, —OCO— group and aralkylene groups (for example,

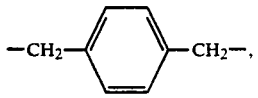

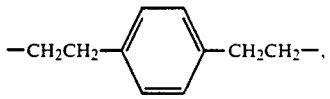

-continued

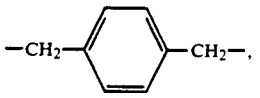

etc.).

Moreover, the vinyl groups in the vinyl monomers include those groups which have substituent groups other than those represented by the general formulae (I-1) to (I-5). The preferred substituent groups are a hydrogen atom, a chlorine atom, and lower alkyl groups which have from 1 to 4 carbon atoms.

The non-color forming ethylenic monomers which do not couple with the oxidation products of primary aromatic amine developing agents include acrylic acid, α-chloroacrylic acid, α-alacrylic acids (for example, methacrylic acid, etc.) and esters and amides derived from these acrylic acids (for example, acrylamide, n-butylacrylamide, t-butylacrylamide, diacetoneacrylamide, methacrylamide, methyl acrylate, ethyl acrylate, n-propyl acrylate, n-butyl acrylate, tert-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate (sic), methylenebisacrylamide, vinyl esters (for example, vinyl acetate, vinyl propionate and vinyl laurate), acrylonitrile, methacrylonitrile, aromatic vinyl compounds (for example, styrene and derivatives thereof, vinyltoluene, divinylbenzene, vinylacetophenone and sulfostyrene), itaconic acid, citraconic acid, crotonic acid, vinylidene chloride, vinyl alkyl ethers (for example, vinyl ethyl ether), maleic acid, maleic anhydride, maleic acid esters, N-vinyl-2-pyrrolidone, N-vinyl-pyridine, 2- and 4-vinyl pyridine, etc. Cases in which two or more of the non-color forming ethylenic monomers which can be used here are used conjointly are also included.

Couplers which can be represented by the above mentioned general formulae (I-1) to (I-5) can be prepared using the methods of synthesis described in the literature indicated below.

Thus, compounds of general formula (I-1) can be prepared using the methods disclosed in JP-A-59-162548, etc., compounds of general formula (I-2) can be prepared using the methods disclosed in JP-A-59-171956, etc., compounds of general formula (I-3) can be prepared using the methods disclosed in U.S. Pat. No. 3,725,067, etc., compounds of general formula (I-4) can be prepared using the methods disclosed in JP-A-60-33552, and compounds of general formula (I-5) can be prepared using the methods disclosed in U.S. Pat. Nos. 3,061,432 and 3,369,897, etc.

The coupler represented by the general formula (I) is generally incorporated in a silver halide emulsion layer in an amount of from 0.1 to 1.0 mol, preferably from 0.1 to 0.5 mol per mol of silver halide.

Actual examples of couplers which can be represented by the general formula (I) are indicated below, but the invention is not limited to these examples.

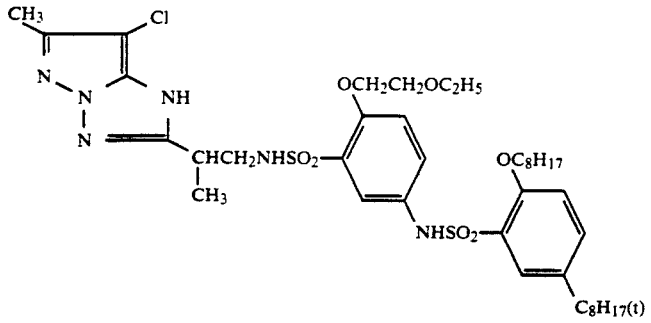
I-1
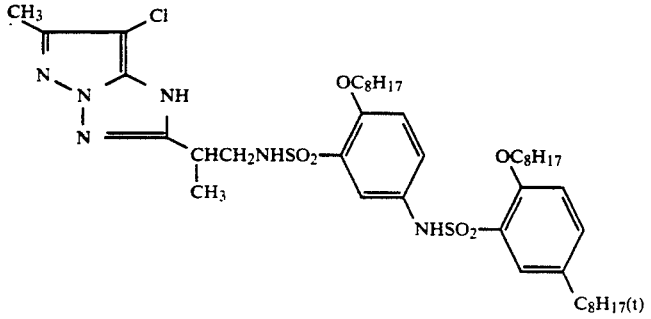
I-2
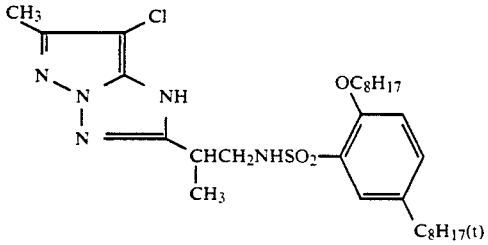
I-3
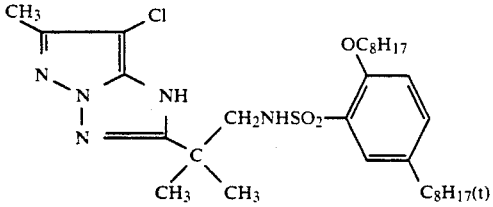
I-4
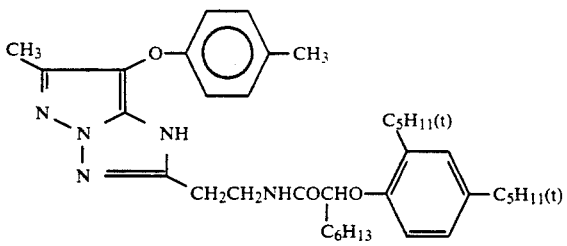
I-5
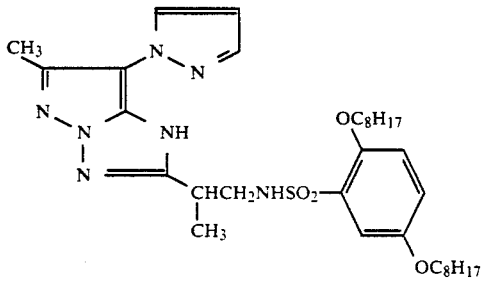
I-6

-continued
I-7
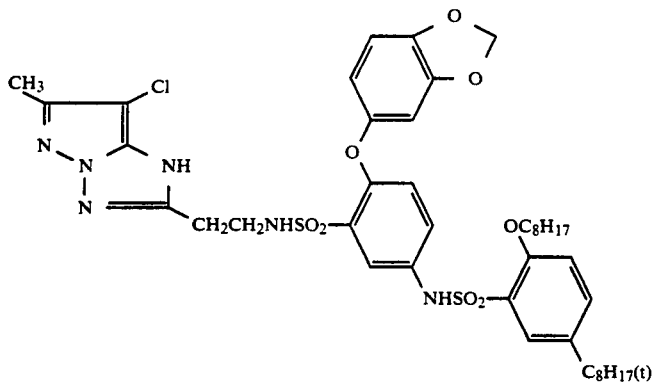
I-8
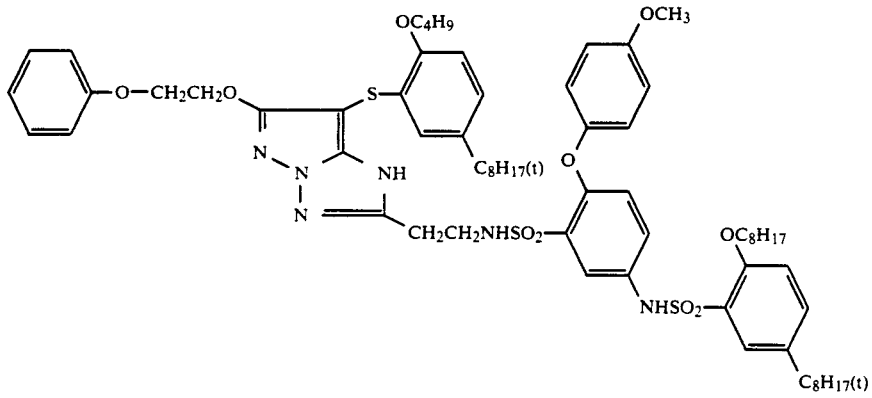
I-9
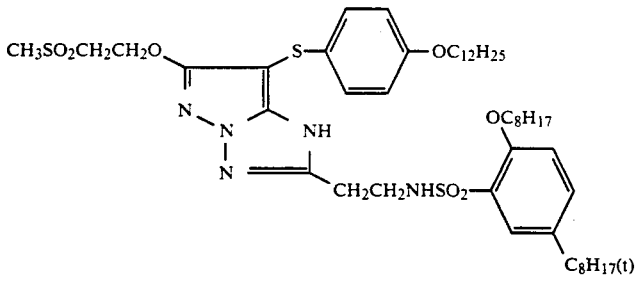
I-10
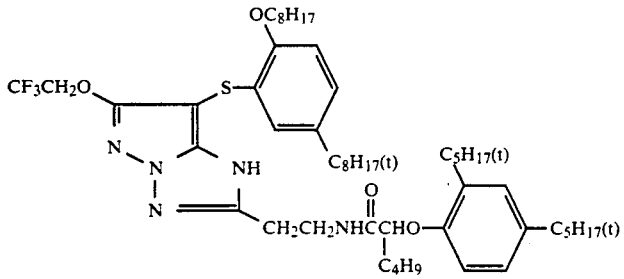

-continued
I-11
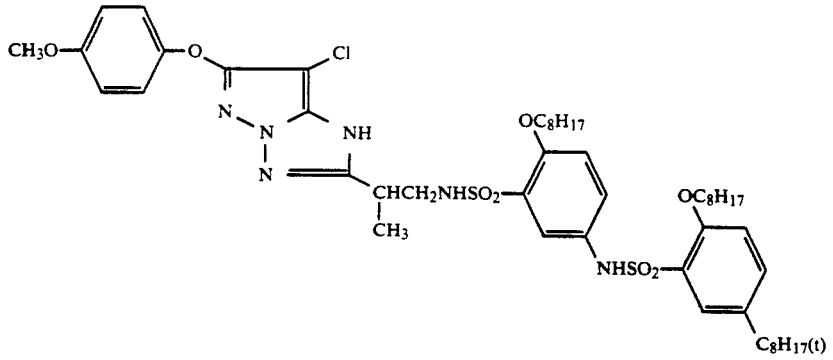
I-12
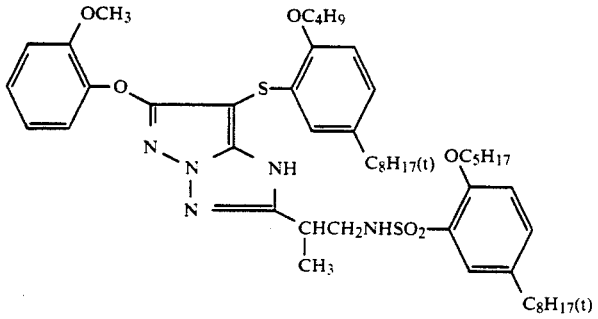
I-13
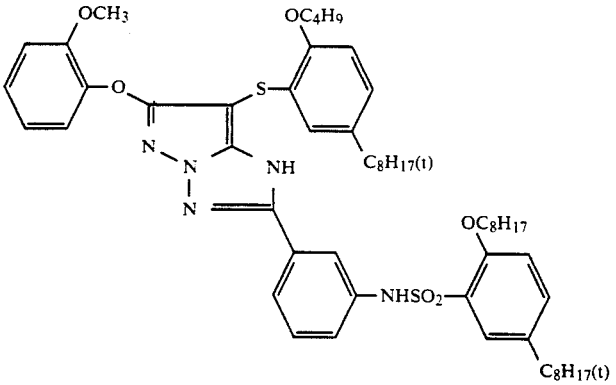
I-14
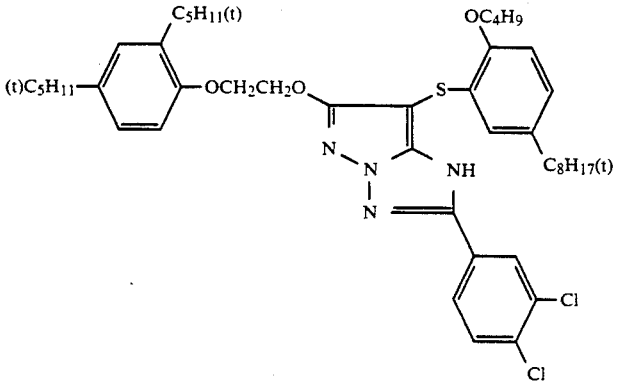

-continued
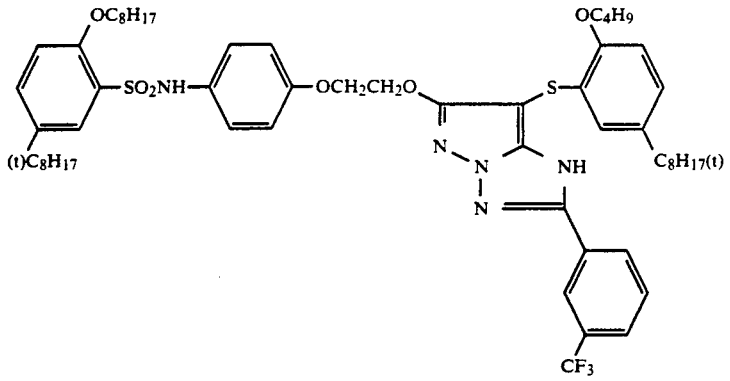
I-15
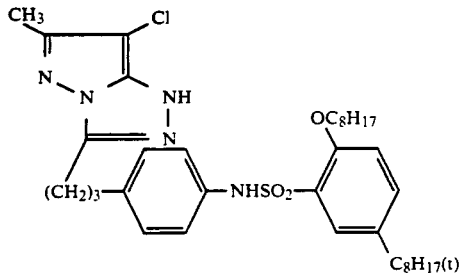
I-16
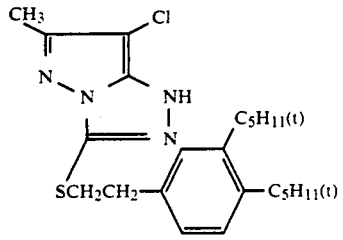
I-17
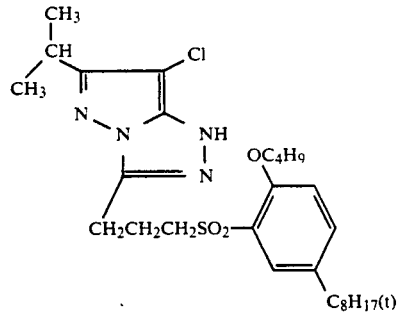
I-18
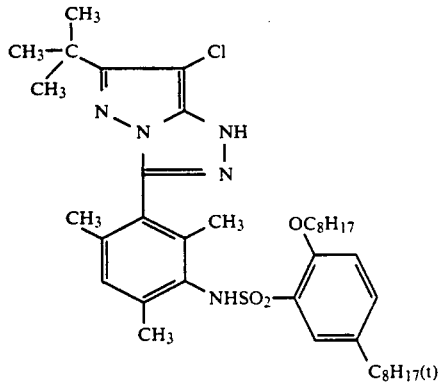
I-19

-continued
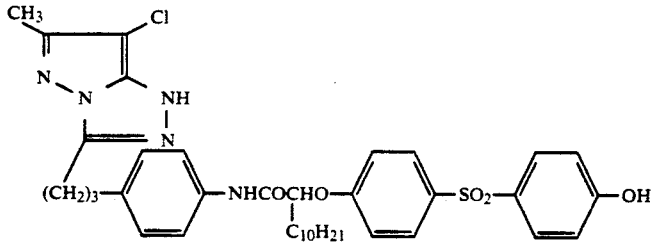
I-20
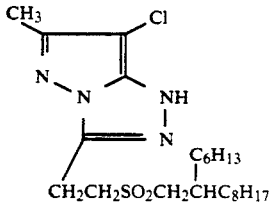
I-21
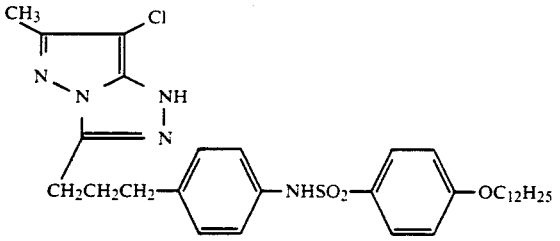
I-22
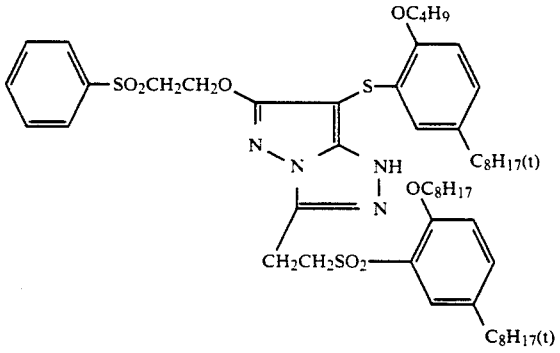
I-23
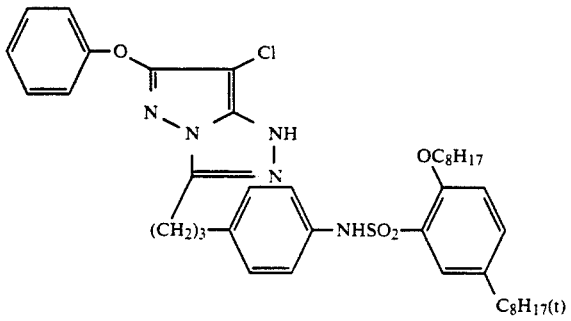
I-24

-continued
I-25
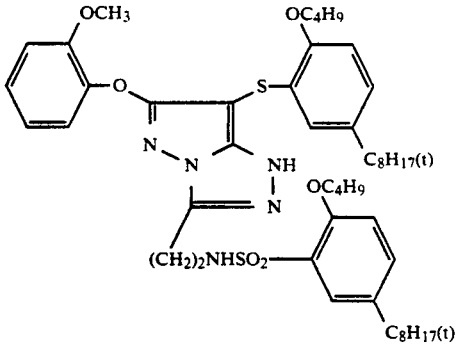
I-26
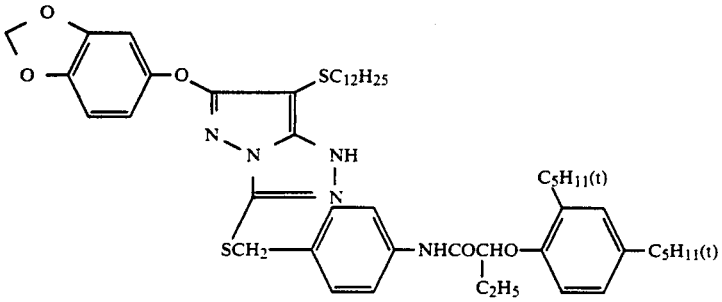
I-27
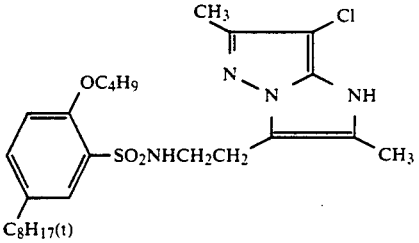
I-28
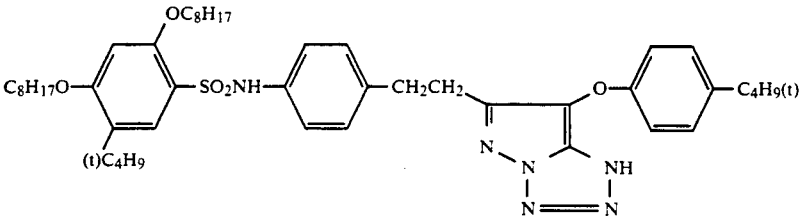
I-29
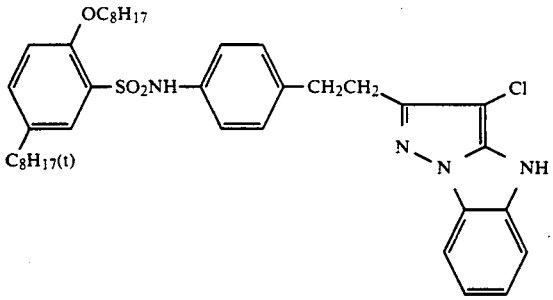
I-30
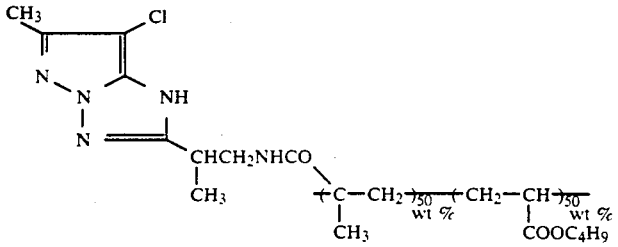

-continued

I-31

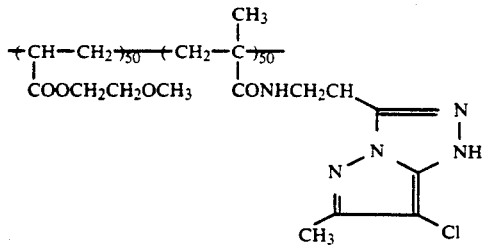

I-32

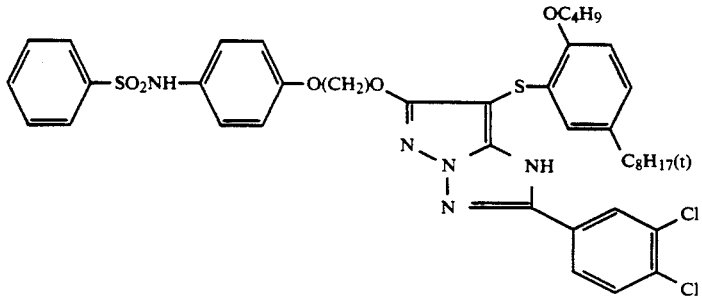

I-33

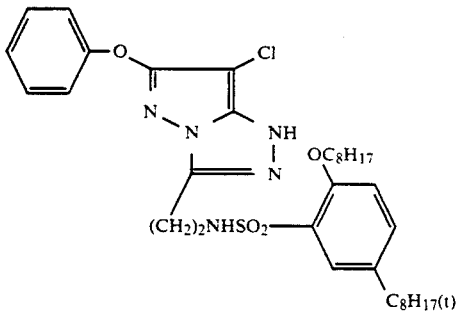

I-34

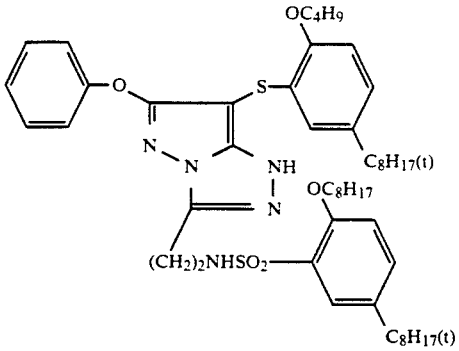

The ester based solvents which can be represented by general formulae (II) and (III) used in the invention are described in detail below.

$$R_2—(COOR_3)_m \quad (II)$$

$$(R_4COO)_n—R_5 \quad (III)$$

When, in these formulae, m or n is 2, then $R_2$ or $R_5$ is an alkylidene group (for example, ethylidene, isopropylidene, cyclohexylidene, etc.), an alkylene group (for example, methylene, ethylene, ethylethylene, propylene, trimethylene, tetramethylene, pentamethylene, hexamethylene, heptamethylene, octamethylene, undecamethylene, 2,2-dimethyltrimethylene, 1,2-cyclohexylene, 1,4-cyclohexylene, 3,4-epoxycyclohexan-1,2-ylene, 3,8-tricyclo(5,2,1,$0^{2,6}$)decylene, etc.), or an alkenylene group (e.g., vinylene, propenylene, 4-cyclohexen-1,2-ylene, 2-pentenylene, 4-propen-2-octenylene, etc.), when m or n is 3 then $R_2$ or $R_5$ is an alkanetriyl group (e.g., 1,2,3-propanetriyl, 1,2,4-butanetriyl, 2-hydroxy-1,2,3-propanetriyl, 2-acetyloxy-1,2,3-propanetriyl, 1,5,8-octanetriyl, etc.), or an alkenetriyl group (e.g., 1,2,3-propenetriyl, 2-butene-1,2,4-triyl, 2,6-octadiene-1,4,8-triyl, etc.), when m or n is 4 then $R_2$ or $R_5$ is an alkanetetrayl group (e.g., 1,2,3,4-butanetetrayl, 1,3-propanediyl-2-ylidene, 1,3,5,8-octanetetrayl, etc.), or an alkenetetrayl group (e.g., 1-butene-1,2,3,4-tetrayl, 3-octene-1,3,5,8-tetrayl, etc.), and when m or n is 5 then $R_2$ or $R_5$ is an alkanepentayl group (1,2,3,4,5-pentanepentayl, 1,2,3,5,6-hexanepentayl, etc.) or an alkenepentayl group (2-pentene-1,2,3,4,5-pentayl group, 3,5-decadiene-1,2,8,9,10-pentayl group, etc.).

Moreover, m and n represent an integer value of from 2 to 5, preferably of value 2 or 3, and most desirably of value 2.

$R_2$ and $R_4$ represent alkyl groups, alkenyl groups or alkynyl groups which have not more than 20 carbon atoms, and they are preferably linear chain or branched chain alkyl groups, such as a methyl group, an ethyl group, an n-butyl group, a pentyl group, a neopentyl group, a hexyl group, a cyclohexyl group, an octyl group, a 2-ethylhexyl group, a decyl group, a dodecyl group, a hexadecyl group, an eicosanyl group, etc., alkenyl groups such as a 2-butenyl group, a 2-pentenyl group, a 2-nonyl-2-butenyl group, an 1,2-octadienyl group, etc., or alkynyl groups such as a 2-propynyl group, a 2-penten-4-ynyl group, an octan-5-ynyl group, etc., but they are preferably alkyl groups.

$R_2$, $R_3$, $R_4$ and $R_5$ may have further substituent groups, and the preferred substituent groups are alkoxy groups, aryloxy groups, epoxy groups, a hydroxyl group, acyloxy groups, aryl groups, alkylthio groups, arylthio groups, acyl groups, acylamino groups, ketone groups, halogen atoms, etc., and most desirably the substituent groups are alkoxy groups (e.g., methoxy, butoxy, butoxyethoxy, etc.), epoxy groups, a hydroxyl group, acyloxy groups (acetyloxy group, propionyloxy group, cyclohexanoyloxy group, etc.), or halogen atoms (e.g., a fluorine atom, etc.).

Actual examples of ester based solvents which can be represented by the general formulae (II) and (III) are indicated below, but the invention is not limited to these examples.

II-1

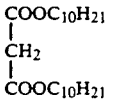

II-2

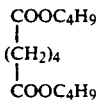

II-3

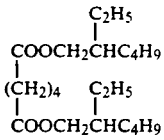

II-4

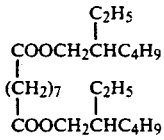

II-5

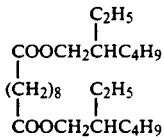

II-6

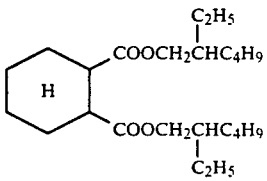

-continued

II-7

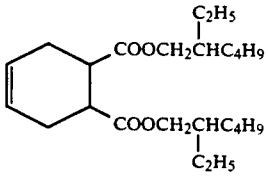

II-8

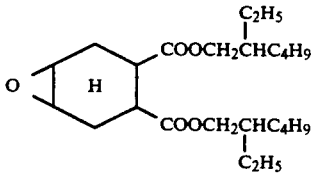

II-9

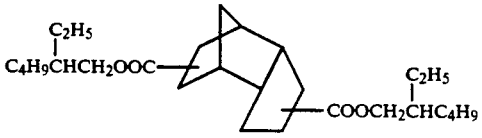

II-10

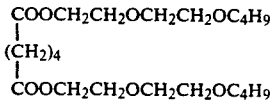

II-11

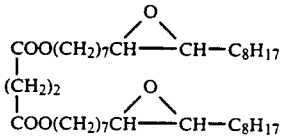

II-12

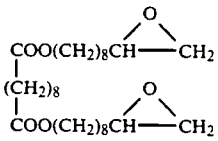

II-13

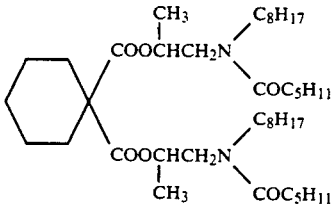

II-14

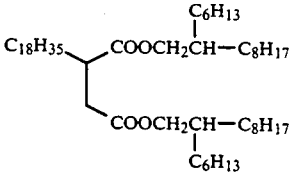

II-15

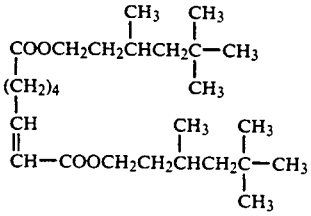

II-16

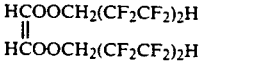

-continued
II-17
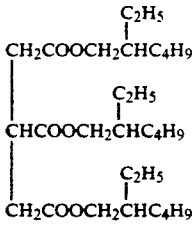
II-18
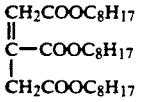
II-19
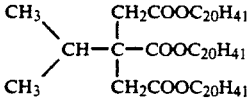
II-20
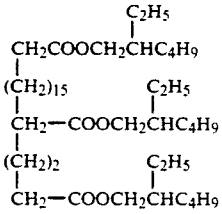
II-21
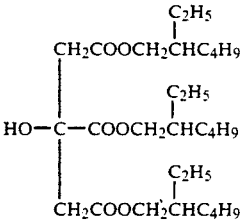
II-22
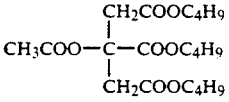
II-23
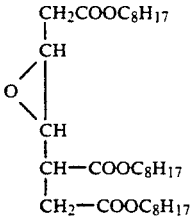
II-24
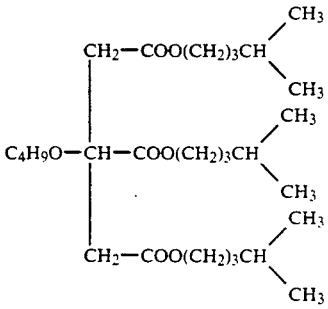
-continued
II-25
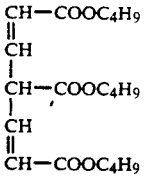
II-26
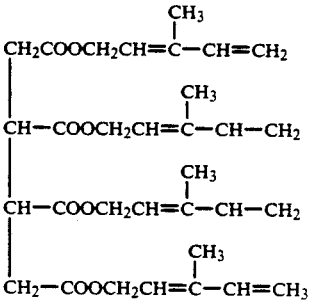
II-27
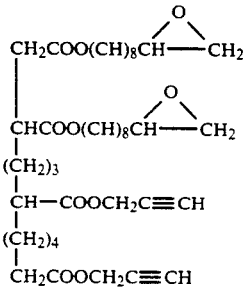
II-28
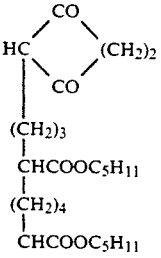
II-29
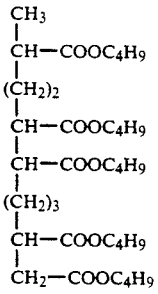
II-30
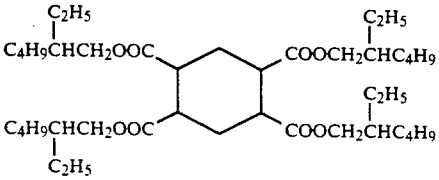
II-31
$(n)C_8H_{17}OOC(CH_2)_7COOC_8H_{17}(n)$ -continued
III-1
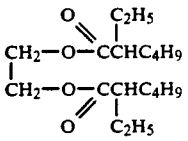
III-2
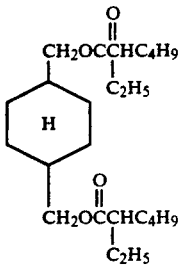
III-3
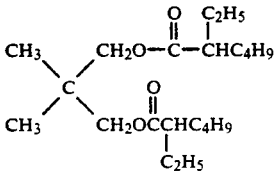
III-4
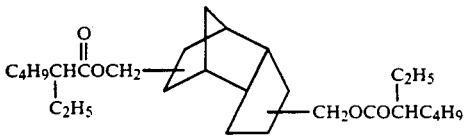
III-5
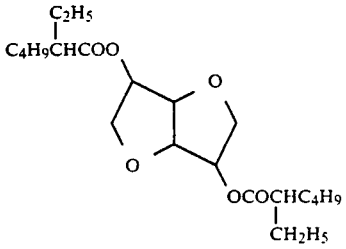
III-6
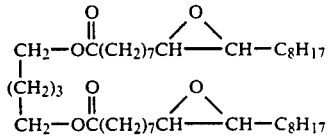
III-7
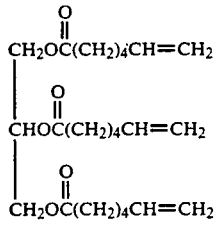
III-8
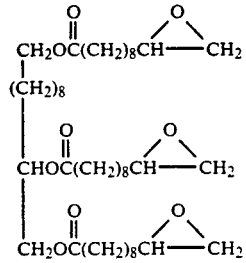
-continued
III-9
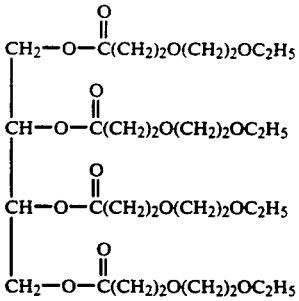
III-10
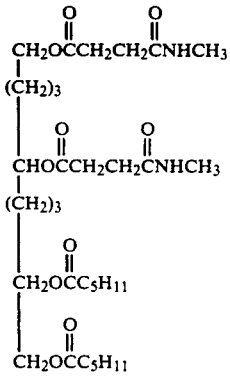
III-11
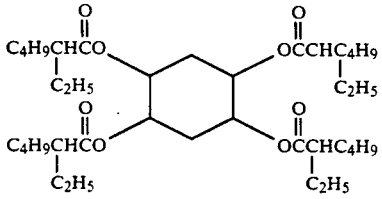
III-12
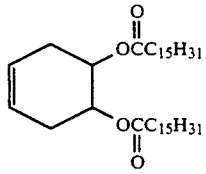
III-13
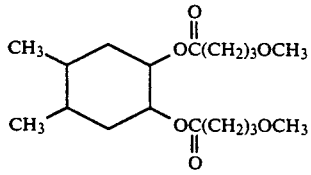
III-14
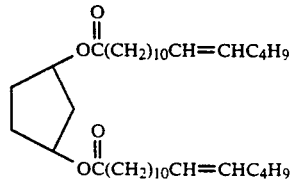

-continued

III-15

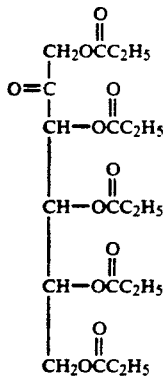

III-16

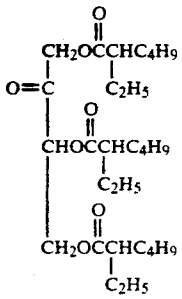

III-17

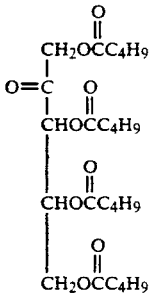

The water insoluble, organic solvent soluble polymers preferably used in this invention are non-color-forming polymers and more preferably have a glass transition temperature of at least 60° C. and, most desirably, they have a glass transition temperature of at least 90° C.

Preferred polymers are those having relative fluorescence quantum yield, K-value, of 0.2 or more, preferably 0.25 or more, and more preferably 0.3 or more. The polymers having higher K-value are more preferred.

The K-value is a relative fluorescence quantum yield, in polymers, of Compound A having the following structure, Compound A being one of the dyes which are often used as fluorescent probes. The X-value is defined by the following equation.

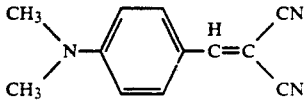

Compound A $K = \Phi_a/\Phi_b$ wherein $\Phi_a$ and $\Phi_b$ are the the fluorescence quantum yields of Compound A in polymers a and b, respectively, and determined in accordance with the method described, for example, in *Macromolecules*, 14, 587 (1981).

Specifically, the K-value was calculated using $\Phi_a$ and $\Phi_b$, which were obtained by measuring at room temperature using thin films of polymers containing Compounds A at a concentration of 0.5 mmol/kg (note: the thin films were spin-coated on a slide glass in such a thickness that the absorbance of Compound A at λmax was from 0.05 to 0.1). In the present invention, the K-value specified above was that obtained when poly(-methylmethacrylate) with a number average molecular weight of 20,000, was used as polymer b.

The preferred structures are indicated below.

1) Water insoluble, organic solvent soluble homopolymers or copolymers in which the repeating unit from which the polymer is formed has a

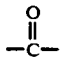

group in the main chain or in a side chain.

More desirably:

2) Water insoluble, organic solvent soluble homopolymers or copolymers in which the repeating unit from which the polymer is formed has a

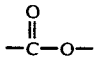

group in the main chain or in a side chain.

3) Water insoluble, organic solvent soluble homopolymers or copolymers in which the repeating unit from which the polymer is made has a

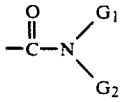

group in the main chain or in a side chain where $G_1$ and $G_2$ each represent a hydrogen atom, or a substituted or unsubstituted alkyl or aryl group, but no more than one of $G_1$ and $G_2$ are a hydrogen atom.

Most desirably, they are polymers in which, in the polymers described in (3) above, one of $G_1$ and $G_2$ is a hydrogen atom and the other is a substituted or unsubstituted alkyl or aryl group which has from 3 to 12 carbon atoms.

Actual examples polymers which can be used in the invention are described below, but the invention is not limited to these examples.

(A) Vinyl Polymers

Monomers which can be used to form vinyl polymers of this invention include acrylic acid esters, of which actual example include methyl acrylate, ethyl acrylate, n-propyl acrylate, iso-propyl acrylate, n-butyl acrylate, iso-butyl acrylate, sec-butyl acrylate, tert-butyl acrylate, amyl acrylate, hexyl acrylate, 2-ethylhexyl acrylate, octyl acrylate, tert-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzylacrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethylacrylate, 2-(2-butoxyethoxy)ethyl acrylate, ω-methoxypolyethyleneglycol acrylate (number of mols added n=9), 1-bromo-2-methoxyethyl acrylate, 1,1-dichloro-2-ethoxyethyl acrylate, etc. Moreover, the monomers, etc. indicated below can also be used.

Methacrylic acid esters: Actual example include methyl methacrylate, ethyl methacrylate, n-propyl methacrylate, iso-propyl methacrylate, n-butyl methacrylate, iso-butyl methacrylate, sec-butyl methacrylate, tert-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethyleneglycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-iso-propoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethyleneglycol methacrylate (number of mols added n=6), allyl methacrylate, methacrylic acid dimethylaminoethylmethyl chloride, etc.

Vinyl esters: Actual examples include vinyl acetate, vinyl propionate, vinyl butyrate, vinyl isobutyrate, vinyl caproate, vinyl chloroacetate, vinyl methoxyacetate, vinyl phenylacetate, vinyl benzoate, vinyl salicylate, etc.

Acrylamides: For example, acrylamide, methylacrylamide, ethylacrylamide, propylacrylamide, butylacrylamide, tert-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, diacetoneacrylamide, tert-octylacrylamide, etc.

Methacrylamides: For example, methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, N-(2-acetoacetoxyethyl)methacrylamide, etc.

Olefins: For example, dicyclopentadiene, ethylene, propylene, 1-butene, 1-pentene, vinyl chloride, vinylidene chloride, isoprene, chloroprene, butadiene, 2,3-dimethylbutadiene, etc.; styrenes, for example, styrene, methylstyrene, dimethylstyrene, trimethylstyrene, ethylstyrene, iso-propylstyrene, chloromethylstyrene, methoxystyrene, acetoxystyrene, chlorostyrene, dichlorostyrene, bromostyrene, methyl vinylbenzoate, etc.

Vinyl ethers: For example, methyl vinyl ether, butyl vinyl ether, hexyl vinyl ether, methoxyethyl vinyl ether, dimethylaminoethyl vinyl ether, etc.

Other compounds, for example, butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, vinylidene, etc.

Two or more of the monomers (for example, the above mentioned monomers which can be used in polymers of this invention) can be used as co-monomers for various purposes (for example, for improving solubility). Furthermore, monomers which have acid groups such as those indicated below can also be used as co-monomers for the adjustment of coloring properties and solubility provided that the copolymer remains insoluble in water.

Acrylic acid; methacrylic acid; itaconic acid; maleic acid; monoalkyl itaconates, for example, monomethyl itaconate, monoethyl itaconate, monobutyl itaconate etc.; monoalkyl maleates, for example, monomethyl maleate, monoethylmaleate, monobutyl maleate, etc.; citraconic acid; styrenesulfonic acid; vinylbenzylsulfonic acid; vinylsulfonic acid, acryloyloxyalkylsulfonic acids, for example, acryloyloxymethylsulfonic acid, acryloyloxyethylsulfonic acid, acryloyloxypropylsulfonic acid, etc.; methacryloyloxyalkylsulfonic acids, for example, methacryloyloxymethylsulfonic acid, methacryloyloxyethylsulfonic acid, methacryloyloxypropylsulfonic acid, etc.; acrylamidoalkylsulfonic acids, for example, 2-acrylamido-2-methylethanesulfonic acid, 2-acrylamido-2-methylpropanesulfonic acid, 2-acrylamido-2-methylbutanesulfonic acid etc.; methacrylamidoalkylsulfonic acids, for example, 2-methacrylamido-2-methylethanesulfonic acid, 2-methacrylamido-2-methylpropanesulfonic acid, 2-methacrylamido-2-methylbutanesulfonic acid etc.; and the alkali metal (for example, sodium, potassium, etc.) or ammonium ion salts of these acids.

In cases where a hydrophilic monomer (here, this signifies a monomer which forms a water soluble homopolymer) is used as a co-monomer with the vinyl monomers indicated here or other vinyl monomers which can be used in the invention, no particular limitation is imposed on the proportion of hydrophilic monomer in the copolymer, provided that the copolymer does not become water soluble, but normally such monomers are used in an amount not exceeding 40 mol %, preferably not exceeding 20 mol % and, most desirably, in an amount not exceeding 10 mol %. Furthermore, in cases where the hydrophilic co-monomer copolymerized with a monomer of this invention has acid groups, the proportion in the copolymer of the co-monomer which has acid groups is normally not more than 20 mol %, and preferably not more than 10 mol %, from the point of view of the image storage properties as mentioned earlier, and the absence of copolymers of this type is most desirable.

The monomers in the polymers in this invention are preferably methacrylate based, acrylamide based or methacrylamide based monomers. The acrylamide and methacrylamide based monomers are especially desirable.

(B) Polymers Formed by Condensation and Polyaddition Reactions

Polyesters formed from polyhydric alcohols and polybasic acids and polyamides formed from diamines and dibasic acids, and from ω-amino-ω'-carboxylic acids, are generally known as condensation polymers, and polymers such as the polyurethanes which are formed from diisocyanates and dihydric alcohols are known as polymers which have been formed by means of a polyaddition reaction.

Glycols which have an OH—$R_1$—OH structure (where $R_1$ is a hydrocarbon chain, especially an aliphatic hydrocarbon chain, which has from 2 to about 12 carbon atoms), and polyalkyleneglycols are effective as polyhydric alcohols, and acids which have an HOO-C—$R_2$—COOH structure (where $R_2$ represents a single bond or a hydrocarbon chain which has from 1 to about 12 carbon atoms) are effective as polybasic acids.

Actual examples of polyhydric alcohols include ethyleneglycol, diethyleneglycol, triethyleneglycol, 1,2-propyleneglycol, 1,3-propylene glycol, trimethylolpropane, 1,4-butanediol, iso-butylenediol, 1,5-pentanediol, neopentylglycol, 1,6-hexanediol, 1,7-heptanediol, 1,8-octanediol, 1,9-nonanediol, 1,10-decanediool, 1,11-undecanediol, 1,12-dodecanediol, 1,13-tridecanediol, glycerine, diglycerine, triglycerine, 1-methylglycerine, erythritol, mannitol, sorbitol, etc.

Actual examples of polybasic acids include oxalic acid, succinic acid, glutaric acid, adipic acid, pimelic acid, suberic acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, metaconic acid, isopymelic acid, cyclopendadiene-maleic anhydride adduct, rosinmaleic anhydride adduct, etc.

Examples of diamines include hydrazine, methylenediamine, ethylenediamine, trimethylenediamine, tetramethylenediamine, hexamethylenediamine, dodecylmethylenediamine, 1,4-diaminocyclohexane, 1,4-diaminomethylcyclohexane, o-aminoaniline, p-aminoaniline, 1,4-diaminomethylbenzene, (4-aminophenyl)ether, etc.

Examples of ω-amino-ω-carboxylic acids include glycine, β-alanine, 3-aminopropanoic acid, 4-aminobutanoic acid, 5-aminopentanoic acid, 11-aminododecanoic acid, 4-aminobenzoic acid, 4-(2-aminoethyl)benzoic acid, 4-(4-aminophenyl)butanoic acid, etc.

Examples of diisocyanates include ethylenediisocyanate, hexamethylenediisocyanate, m-phenylenediisocyanate, p-phenylenediisocyanate, p-xylenediisocyanate, 1,5-naphthyldiisocyanate, etc.

(C) Others

For example, polyesters and polyamides which can be obtained by ring opening polymerization can be used.

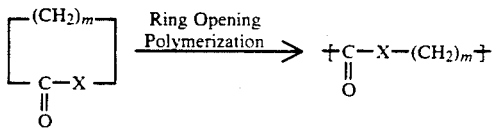

X in this equation represents an —O— group or an —NH— group, and m represents an integer of value 4 to 7. The —$CH_2$— groups may be branched.

Monomers of this type include β-propiolactone, ε-caprolactone, dimethylpropiolactone, α-pyrrolidone, α-piperidone, ε-caprolactam and α-methyl-ε-caprolactam, etc.

Two or more of any of the types of polymer of this invention disclosed above can be used conjointly.

The molecular weight and degree of polymerization of the polymer of this invention have no great effect in practice on the effect of the invention, but problems arise with long time taken to dissolve in an auxiliary solvent as the molecular weight increases, and emulsification and dispersion become difficult because of the high solution viscosity, coarse particles are formed, and this can have an adverse effect on the color forming properties and it is also liable to give rise to problems such as failure of the coating properties. Reduction of the viscosity of the solution using large amounts of auxiliary solvent to overcome this problem gives rise to problems with a coating process. From the above mentioned point of view, the viscosity on dissolving 30 grams of the polymer in 100 cc of the auxiliary solvent which is being used is preferably not more than 5000 cps, and most desirably it is not more than 2000 cps. The molecular weights of the polymers which can be used in the invention are preferably not more than 150,000, and most desirably they are not more than 100,000.

In this invention a water insoluble polymer is a polymer of which the solubility is not more than 3 grams, and preferably not more than 1 gram, in 100 grams of distilled water.

The proportion with respect to the auxiliary solvent of the polymer of this invention differs according to the type of polymer which is being used, and varies over a wide range depending on solubility in the auxiliary solvent, the degree of polymerization, the solubility of the coupler, etc. Normally, the amount of auxiliary solvent used is that which is required to provide a solution on dissolving at least the coupler, the high boiling point coupler solvent and the polymer in the auxiliary solvent which has a sufficiently low viscosity for easy dispersion in water or in an aqueous hydrophilic colloid solution. The viscosity of the solution increases as the degree of polymerization of the polymer increases and so the proportion with respect to the auxiliary solvent of the polymer is not dependent just on the type of polymer and it is difficult to formulate a general rule, but normally a proportion (by weight) of from about 1:1 to 1:50 is preferred. The proportion (by weight) with respect to the coupler of the polymer of this invention is preferably from 1:20 to 20:1, and most desirably it is from 1:10 to 10:1.

Some actual examples of polymers which can be used in the invention are indicated below, but the invention is not limited to these examples.

| Example | Type of Polymer |
|---|---|
| P-1) | Poly(vinyl acetate) |
| P-2) | Poly(vinyl propionate) |
| P-3) | Poly(methyl methacrylate) |
| P-4) | Poly(ethyl methacrylate) |
| P-5) | Poly(ethyl acrylate) |
| P-6) | Vinyl acetate/vinyl alcohol copolymer (95:5) |
| P-7) | Poly(n-butyl acrylate) |
| P-8) | Poly(n-butyl methacrylate) |
| P-9) | Poly(iso-butyl methacrylate) |

-continued

| Example | Type of Polymer |
|---|---|
| P-10) | Poly(iso-propyl methacrylate) |
| P-11) | Poly(decyl methacrylate) |
| P-12) | n-Butyl acrylate/acrylamide copolymer (95:5) |
| P-13) | Poly(methyl chloroacrylate) |
| P-14) | 1-4-Butanediol/adipic acid polyester |
| P-15) | Ethyleneglycol/sebacic acid polyester |
| P-16) | Polycaprolactam |
| P-17) | Poly(2-tert-butylphenyl acrylate) |
| P-18) | Poly(4-tert-butylphenyl acrylate) |
| P-19) | n-Butyl methacrylate/N-vinyl-2-pyrrolidone copolymer (90:10) |
| P-20) | Methyl methacrylate/vinyl chloride copolymer (70:30) |
| P-21) | Methyl methacrylate/styrene copolymer (90:10) |
| P-22) | Methyl methacrylate/ethyl acrylate copolymer (50:50) |
| P-23) | n-Butyl methacrylate/methyl methacrylate/ styrene copolymer (50:30:20) |
| P-24) | Vinyl acetate/acrylamide copolymer (85:15) |
| P-25) | Vinyl chloride/vinyl acetate copolymer (65:35) |
| P-26) | Methyl methacrylate/acrylonitrile copolymer (65:35) |
| P-27) | Diacetoneacrylamide/methyl methacrylate copolymer (50:50) |
| P-28) | Vinyl methyl ketone/isobutyl methacrylate copolymer (55:45) |
| P-29) | Ethyl methacrylate/n-butyl acrylate copolymer (70:30) |
| P-30) | Diacetoneacrylamide/n-butyl acrylate copolymer (60:40) |
| P-31) | Methyl methacrylate/cyclohexyl methacrylate copolymer (50:50) |
| P-32) | n-Butyl acrylate/phenyl methacrylate/ diacetoneacrylamide copolymer (70/20/10) |
| P-33) | N-tert-Butylmethacrylamide/methyl meth-acrylate/acrylic acid copolymr (60:30:10) |
| P-34) | Methyl methacrylate/styrene/vinylsulfonamide copolymer (70:20:10) |
| P-35) | Methyl methacrylate/phenyl vinyl ketone copolymer (70:30) |
| P-36) | n-Butyl acrylate/methyl methacrylate/n-butyl methacrylate copolymer (35:35:30) |
| P-37) | n-Butyl methacrylate/pentyl methacrylate/N-vinyl-2-pyrrolidone copolymer (38:38:24) |
| P-38) | Methyl methacrylate/n-butyl methacrylate/ isobutyl methacrylate/acrylic acid copolymer (37:29:25:9) |
| P-39) | n-Butyl methacrylate/acrylic acid copolymer (95:5) |
| P-40) | Methyl methacrylate/acrylic acid copolymer (95:5) |
| P-41) | Benzyl methacrylate/acrylic acid copolymer (90:10) |
| P-42) | n-Butyl methacrylate/methyl methacrylate/ benzyl methacrylate/acrylic acid copolymer (35:35:25:5) |
| P-43) | n-Butyl methacrylate/methyl methacrylate/ benzyl methacrylate copolymer (35:35:30) |
| P-44) | Poly (3-pentyl acrylate) |
| P-45) | Cyclohexyl methacrylate/methyl methacrylate/ n-propyl methacrylate copolymer (37:29:34) |
| P-46) | Poly(pentyl methacrylate) |
| P-47) | Methyl methacrylate/n-butyl methacrylate copolymer (65:35) |
| P-48) | Vinyl acetate/vinyl propionate copolymer (75:25) |
| P-49) | n-Butyl methacrylate/3-acryloxybutane-1-sulfonic acid, sodium salt, copolymer (97:3) |
| P-50) | n-Butyl methacrylate/methyl methacrylate/ acrylamide copolymer (35:35:30) |
| P-51) | n-Butyl methacrylate/methyl methacrylate/vinyl chloride copolymer (37:36:27) |
| P-52) | n-Butyl methacrylate/styrene copolymer (90:10) |
| P-53) | Methyl methacrylate/N-vinyl-2-pyrrolidone copolymer (90:10) |
| P-54) | n-Butyl methacrylate/vinyl chloride copolymer (90:10) |
| P-55) | n-Butyl methacrylate/styrene copolymer (70:30) |
| P-56) | Poly(N-sec-butylacrylamide) |
| P-57) | Poly(N-tert-butylacrylamide) |
| P-58) | Diacetoneacrylamide/methyl methacrylate copolymer (62/38) |
| P-59) | Poly(cyclohexyl methacrylate)/methyl methacrylate copolymer (60:40) |
| P-60) | N-tert-Butylacrylamide/methyl methacrylate copolymer (40:60) |
| P-61) | Poly(N-n-butylacrylamide) |
| P-62) | Poly(tert-butyl methacrylate)/N-tert-butyl-acrylamide copolymer (50:50) |
| P-63) | tert-Butyl methacrylate/methyl methacrylate copolymer (70:30) |
| P-64) | Poly(N-tert-butylacrylamide) |
| P-65) | N-tert-Butylacrylamide/methyl methacrylate copolymer (60:40) |
| P-66) | Methyl methacrylate/acrylonitrile copolymer (70:30) |
| P-67) | Methyl methacrylate/vinyl methyl ketone copolymer (38:62) |
| P-68) | Methyl methacrylate/styrene copolymer (75:25) |
| P-69) | Methyl methacrylate/hexyl methacrylate copolymer (70:30) |
| P-70) | Poly(benzyl acrylate) |
| P-71) | Poly(4-biphenyl acrylate) |
| P-72) | Poly(4-butoxycarbonylphenyl acrylate) |
| P-73) | Poly(sec-butyl acrylate) |
| P-74) | Poly(tert-butyl acrylate) |
| P-75) | Poly[3-chloro-2,2-bis(chloromethyl)propyl acrylate] |
| P-76) | Poly(2-chlorophenyl acrylate) |
| P-77) | Poly(4-chlorophenyl acrylate) |
| P-78) | Poly(pentachlorophenyl acrylate) |
| P-79) | Poly(4-cyanobenzyl acrylate) |
| P-80) | Poly(cyanoethyl acrylate) |
| P-81) | Poly(4-cyanophenyl acrylate) |
| P-82) | Poly(4-cyano-3-thiabutyl acrylate) |
| P-83) | Poly(cyclohexyl acrylate) |
| P-84) | Poly(2-ethoxycarbonylphenyl acrylate) |
| P-85) | Poly(3-ethoxycarbonylphenyl acrylate) |
| P-86) | Poly(4-ethoxycarbonylphenyl acrylate) |
| P-87) | Poly(2-ethoxyethyl acrylate) |
| P-88) | Poly(3-ethoxypropyl acrylate) |
| P-89) | Poly(1H,1H,5H-octafluoropentyl acrylate) |
| P-90) | Poly(heptyl acrylate) |
| P-91) | Poly(hexadecyl acrylate) |
| P-92) | Poly(hexyl acrylate) |
| P-93) | Poly(iso-butyl acrylate) |
| P-94) | Poly(iso-propyl acrylate) |
| P-95) | Poly(3-methoxybutyl acrylate) |
| P-96) | Poly(2-methoxycarbonylphenyl acrylate) |
| P-97) | Poly(3-methoxycarbonylphenyl acrylate) |
| P-98) | Poly(4-methoxycarbonylphenyl acrylate) |
| P-99) | Poly(2-methoxyethyl acrylate) |
| P-100) | Poly(4-methoxyphenyl acrylate) |
| P-101) | Poly(3-methoxypropyl acrylate) |
| P-102) | Poly(3,5-dimethyladamantyl acrylate) |
| P-103) | Poly(3-dimethylaminophenyl acrylate) |
| P-104) | Poly(vinyl tert-butyrate) |
| P-105) | Poly(2-methylbutyl acrylate) |
| P-106) | Poly(3-methylbutyl acrylate) |
| P-107) | Poly(1,3-dimethylbutyl acrylate) |
| P-108) | Poly(2-methylpentyl acrylate) |
| P-109) | Poly(2-naphthyl acrylate) |
| P-110) | Poly(phenyl methacrylate) |
| P-111) | Poly(propyl acrylate) |
| P-112) | Poly(m-tolyl acrylate) |
| P-113) | Poly(o-tolyl acrylate) |
| P-114) | Poly(p-tolyl acrylate) |
| P-115) | Poly(N,N-dibutylacrylamide) |
| P-116) | Poly(iso-hexylacrylamide) |
| P-117) | Poly(iso-octylacrylamide) |
| P-118) | Poly(N-methyl-N-phenylacrylamide) |
| P-119) | Poly(adamantyl methacrylate |
| P-120) | Poly(benzyl methacrylate) |
| P-121) | Poly(2-bromoethyl methacrylate) |
| P-122) | Poly(2-N-tert-butylaminoethyl methacrylate) |
| P-123) | Poly(sec-butyl methacrylate) |
| P-124) | Poly(tert-butyl methacrylate) |
| P-125) | Poly(2-chloroethylmethacrylate) |
| P-126) | Poly(2-cyanoethyl methacrylate) |
| P-127) | Poly (2-cyanomethylphenyl methacrylate) |
| P-128) | Poly(4-cyanophenyl methacrylate) |
| P-129) | Poly(cyclohexyl methacrylate) |

-continued

| Example | Type of Polymer |
|---|---|
| P-130) | Poly(dodecyl methacrylate) |
| P-131) | Poly(diethylaminoethyl methacrylate) |
| P-132) | Poly(2-ethylsulfinylethyl methacrylate) |
| P-133) | Poly(hexadecyl methacrylate) |
| P-134) | Poly(hexyl methacrylate) |
| P-135) | Poly(2-hydroxypropyl methacrylate) |
| P-136) | Poly(4-methoxycarbonylphenyl methacrylate) |
| P-137) | Poly(3,5-dimethyladamantyl methacrylate) |
| P-138) | Poly(dimethylaminoethyl methacrylate) |
| P-139) | Poly(3,3-dimethylbutyl methacrylate) |
| P-140) | Poly(3,3-dimethyl-2-butyl methacrylate) |
| P-141) | Poly(3,5,5-trimethylhexyl methacrylate) |
| P-142) | Poly(octadecyl methacrylate) |
| P-143) | Poly(tetradecyl methacrylate) |
| P-144) | Poly(4-butoxycarbonylphenylmethacrylamide) |
| P-145) | Poly(4-carboxyphenylmethacrylamide) |
| P-146) | Poly(4-ethoxycarbonylphenylmethacrylamide) |
| P-147) | Poly(4-methoxycarbonylphenylmethacrylamide) |
| P-148) | Poly(butyl butoxycarbonylmethacrylate) |
| P-149) | Poly(butyl chloroacrylate) |
| P-150) | Poly(butyl cyanoacrylate) |
| P-151) | Poly(cyclohexyl chloroacrylate) |
| P-152) | Poly(ethyl chloroacrylate) |
| P-153) | Poly(ethyl ethoxycarbonylmethacrylate) |
| P-154) | Poly(ethyl ethacrylate) |
| P-155) | Poly(ethyl fluoromethacrylate) |
| P-156) | Poly(hexyl hexyloxycarbonylmethacrylate) |
| P-157) | Poly(iso-butyl chloroacrylate) |
| P-158) | Poly(iso-propyl chloroacrylate) |
| P-159) | Trimethylenediamine/glutaric acid polyamide |
| P-160) | Hexamethylenediamine/adipic acid polyamide |
| P-161) | Poly(2-pyrrolidone) |
| P-162) | Poly(ε-caprolactam) |
| P-163) | Hexamethylenediisocyanate/1.4-butanediol polyurethane |
| P-164) | p-Phenylenediisocyanate/ethylene glycol polyurethane |

EXAMPLE OF SYNTHESIS 1

Preparation of Methyl Methacrylate Polymer (P-3)

Methyl methacrylate (50.0 grams), 0.5 gram of poly(sodium acrylate) and 200 ml of distilled water were introduced into a 500 ml three necked flask and the mixture was heated to 80° C. with stirring under a blanket of nitrogen. Dimethyl azobisisobutyrate (500 mg) was added as a polymerization initiator and polymerization started.

The reaction mixture was cooled after polymerizing for a period of 2 hours and 48.7 grams of the polymer P-3 was obtained by recovering by filtration and washing with water the polymer which had been formed in the form of beads.

EXAMPLE OF SYNTHESIS 2

Preparation of t-Butylacrylamide Polymer (P-57)

t-Butylacrylamide (50.0 grams) and 250 ml of toluene were introduced into a 500 ml three necked flask and heated to 80° C. with stirring under a blanket of nitrogen. A toluene solution (10 ml) containing 500 mg of azobisisobutyronitrile was added as a polymerization initiator and polymerization started.

The reaction mixture was cooled after polymerizing for a period of 3 hours and 47.9 grams of the polymer P-57 was obtained on recovering by filtration the solid which precipitated out on pouring the mixture into 1 liter of hexane, washing the solid with hexane, and drying the product by heating under reduced pressure.

Embodiments of the invention are described below. There are many cases in which a magenta coupler which can be represented by the general formula (I) of this invention is used alone, and this is desirable from the point of view of color reproduction and from the point of view of the prevention of staining due to light but, where desired, mixtures with pyrazolone based magenta couplers which can be represented by the general formula (M-I) indicated below can also be used.

General Formula (M-I)

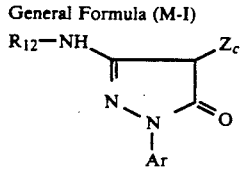

(M-I)

In this formula, $R^{12}$ represents an alkyl group, aryl group, acyl group or carbamoyl group. Ar represents a phenyl group or a phenyl group which is substituted with at least one halogen atom, alkyl group, cyano group, alkoxy group, alkoxycarbonyl group or acylamino group. $Z_C$ represents a hydrogen atom or a group which can be eliminated in a reaction with the oxidized form of a primary aromatic amine developing agent More precisely, the alkyl group of $R^{12}$ in general formula (M-I) is preferably an alkyl group which has from 1 to 42 carbon atoms, and these may be substituted with halogen atoms, alkoxy groups, aryl groups, alkoxycarbonyl groups, aryloxycarbonyl groups, acylamido groups, sulfonamido groups, sulfamoyl groups, carbamoyl groups, aryloxy groups, alkylthio groups, arylthio groups, sulfonyl groups, cyano groups, acyloxy groups, aryloxy groups, imido groups, etc The aryl groups of $R^{12}$ are preferably aryl groups which have from 6 to 46 carbon atoms, and these may be substituted with 1 the same substituent groups as the alkyl groups of $R^{12}$. The acyl groups of $R^{12}$ are preferably aliphatic acyl groups which have from 2 to 32 carbon atoms, and aromatic acyl groups which have from 7 to 46 carbon atoms. These acyl groups may be substituted with the same substituent groups as the alkyl groups of $R^{12}$. The carbamoyl groups of $R^{12}$ are preferably aliphatic carbamoyl groups which have from 2 to 32 carbon atoms or aromatic carbamoyl groups which have from 7 to 46 carbon atoms, and these may be substituted with the same groups as the alkyl groups of $R^{12}$.

$Z_C$ represents a hydrogen atom or a coupling leaving group, and examples of such groups include halogen atoms, alkoxy groups, aryloxy groups, acyloxy groups, sulfonyloxy groups, amido groups, alkoxycarbonyl groups, aryloxycarbonyl groups, aliphatic or aromatic thio groups, imido groups, N-heterocyclic groups, aromatic azo groups, etc. These leaving groups may contain photographically useful groups Dimers or larger oligomers may be formed via $R^{12}$, Ar or $Z_C$ in the general formula (M-I)

Typical examples of pyrazolone based magenta couplers which can be represented by the general formula (M-I) are indicated below, but they are not limited to these examples (m-1)
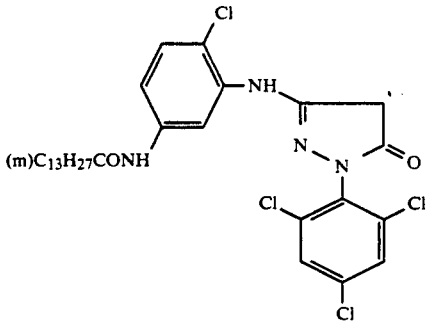
(m-2)
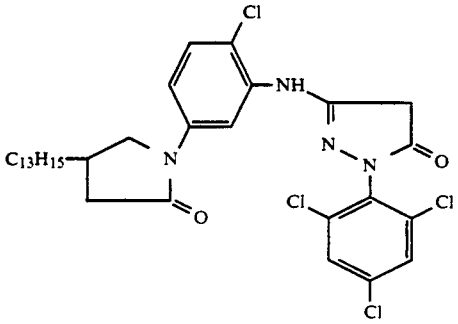
(m-3)
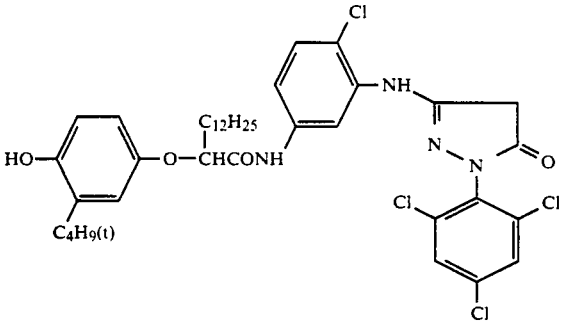
(m-4)
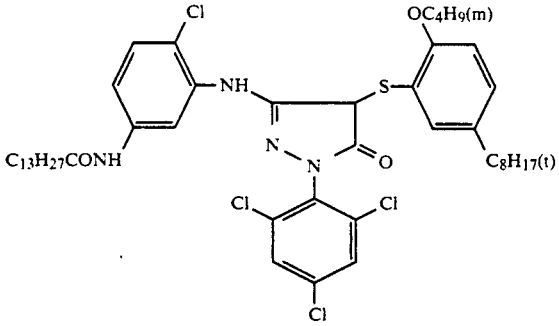
(m-5)
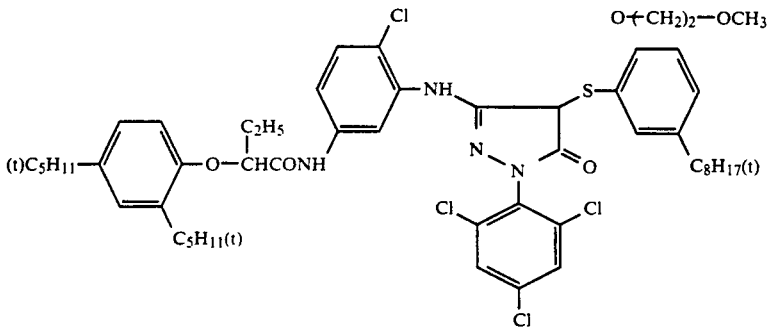

The magenta dye-forming coupler represented by the formula (I), water insoluble but organic solvent soluble polymer, and aliphatic ester solvent represented by the formula (II) or (III) may be incorporated in the same layer or in the different layers.

The magenta dye-forming coupler is preferably incorporated in a green sensitive layer, the polymer is preferably incorporated in a red sensitive layer and/or blue sensitive layer, and the solvent of the formula (II) or (III) is preferably incorporated in a red sensitive layer and/or blue sensitive layer, or light-insensitive hydrophilic colloid layer. The aliphatic ester solvent of formula (II) or (III) is effective in preventing stain when it is incorporated in the light-insensitive hydrophilic colloid layer, especially using together with magenta dye-forming coupler of formula (I).

The ester based solvents which can be represented by the general formulae (II) and (III) of this invention may be used as high boiling point coupler solvents, and they can be used in all the layers or they may be used in only one layer for providing the effect of this invention, and especially the anti-staining effect of the invention. Their effect is most pronounced when they are used, preferably, in the layers other than the green sensitive layer.

The amount of the solvent used varies over a wide range, depending on the type and amount of polymer and coupler, but a ratio by weight of high boiling point coupler solvent/coupler of from 0.05 to 20 is preferred, and a ratio of from 0.1 to 10 is most desirable, while the ratio of high boiling point solvent/polymer is preferably from 0.02 to 40, and most desirably from 0.05 to 20. Furthermore, the ester based organic solvents of this invention can be used individually or as complex mixtures.

Furthermore, any high boiling point organic solvents, such as phosphate ester based solvents, phthalate ester based solvents, monoester based solvents, ether based solvents, alcohol based solvents or phenol based solvents, can be used in the layers in which ester based solvents of this invention are not used.

Moreover, the ester based solvents of this invention can be used in admixture with these solvents. Actual examples of the above mentioned high boiling point solvents other than the ester based solvents of this invention which can be used are indicated below, but these solvents are not limited to the examples.

$O{=}P(OC_4H_{3}\text{-}n)_2$ (S-1)

$O{=}P(OCH_2CH_2CH(CH_3)CH_3)_2$ (S-2)

$O{=}P(OC_6H_{13}\text{-}\underline{n})_2$ (S-3)

(S-4)

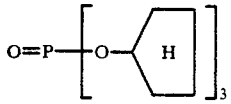

(S-5)

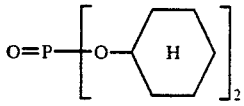

$O{=}P(OC_3H_{17}\text{-}\underline{n})_3$ (S-6)

-continued

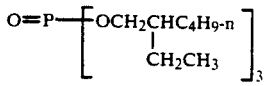

(S-7)

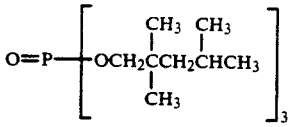

(S-8)

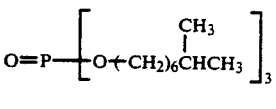

(S-9)

$O{=}P(O(CH_2)_6CHCH_3)_3$ (S-10)

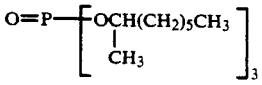

(S-11)

$O{=}P(OC_{20}H_{21}\text{-}n)_3$ (S-12)

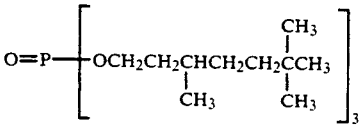

(S-13)

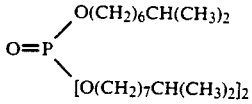

(S-14)

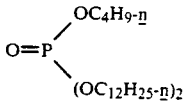

(S-15)

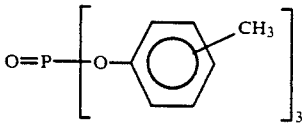

(S-16)

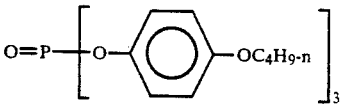

(S-17)

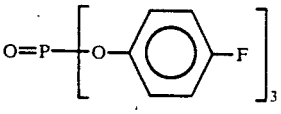

(S-18)

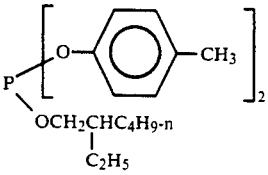

(S-19)

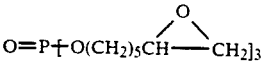

(S-20)

-continued
(S-21)
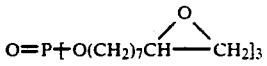
(S-22)
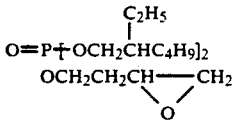
(S-23)
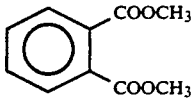
(S-24)
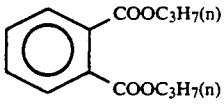
(S-25)
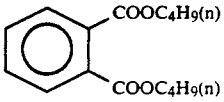
(S-26)
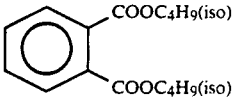
(S-27)
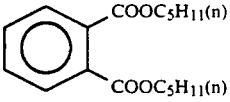
(S-28)
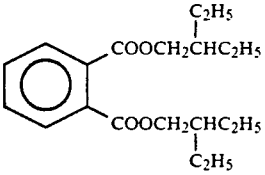
(S-29)
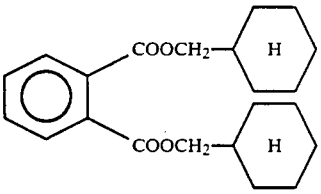
(S-30)
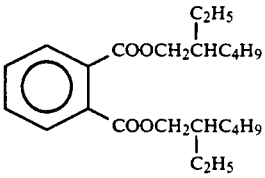
(S-31)
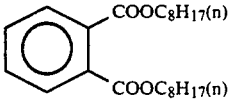
(S-32)
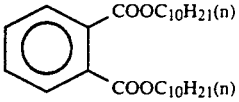
-continued
(S-33)
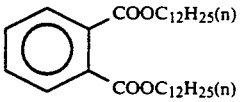
(S-34)
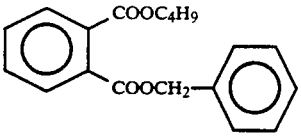
(S-35)
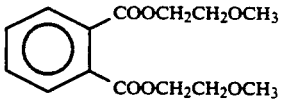
(S-36)
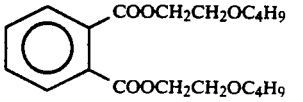
(S-37)
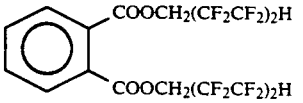
(S-38)
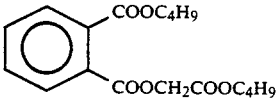
(S-39)
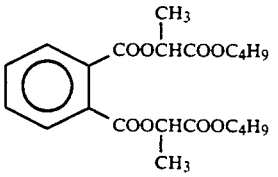
(S-40)
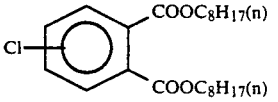
(S-41)
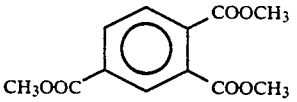
(S-42)
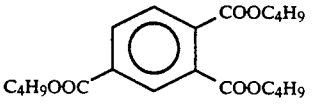
(S-43)
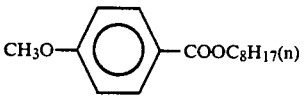
(S-44)
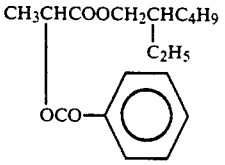

-continued (S-45) 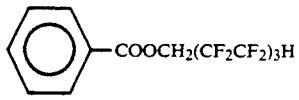

(S-46) 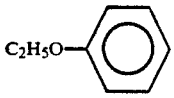

(S-47) 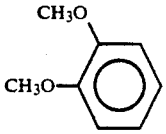

(S-48) 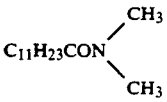

(S-49) $C_{12}H_{25}OH$ (S-50) $C_{15}H_{33}OH$ (S-51) $C_{18}H_{37}OH$ (S-52) $C_{10}H_{21}O(CH_2)_5O(CH_2)_2OH$ (S-53) 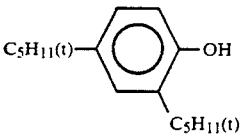

(S-54) 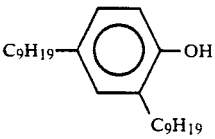

(S-55) 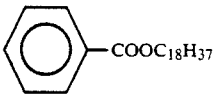

(S-56) 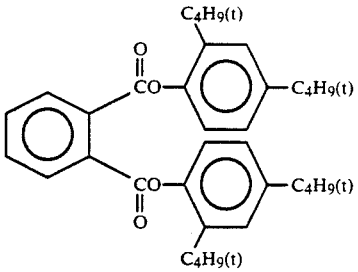

(S-57) 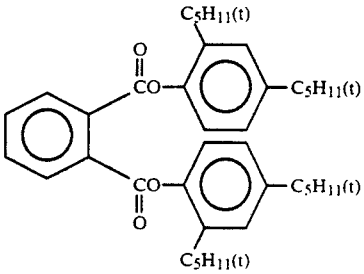

-continued (S-58) 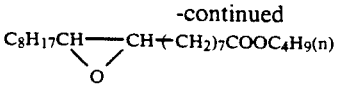

(S-59) 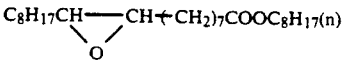

The water insoluble, organic solvent soluble polymer of this invention is normally dissolved in an appropriate organic auxiliary solvent for use, but the proportion with respect to the auxiliary solvent differs according to the type of polymer which is being used, and it varies over a wide range according to the solubility in the auxiliary solvent and the degree of polymerization, or the solubility of the coupler, etc. Normally, the amount of auxiliary solvent required to provide a sufficiently low viscosity such that the solution obtained by dissolving at least the coupler, the high boiling point coupler solvent and the polymer in the auxiliary solvent can be dispersed easily in water or in an aqueous hydrophilic colloid solution is used. The solution viscosity rises as the degree of polymerization of the polymer is increased and so it is difficult to formulate a general rule irrespective of the type of polymer for the proportion with respect to the auxiliary solvent of the polymer, but normally proportions (by weight) within the range from about 1:1 to 1:50 are preferred. The proportion with respect to the coupler of the polymer of this invention is preferably from 1:20 to 20:1, and most desirably from 1:10 to 10:1.

The polymers of this invention improve image stability, the effect of the invention, in whichever layer they are used, but the resulting effect is especially pronounced when they are used in the red sensitive layer, and they provide a marked improvement in the extent dark heat fading and light fading of the cyan image which, as described in the background of the invention, was a problem in the past.

There is also some improvement in respect of the light fading of the yellow image when the polymers are used in the blue sensitive layer.

Finally, there is an improvement overall in the stability on storage of the cyan, magenta and yellow images and it is possible to obtain photographs with which, even on long term storage, the cyan, magenta, yellow color balance is good and with which there is little staining Cyan couplers and yellow couplers which can be used in the invention are described below The oil protected type naphthol based and phenol based couplers can be used as cyan couplers in this invention, and typical examples of naphthol based couplers include those disclosed in U.S. Pat. No. 2,474,293, and the preferred two equivalent naphthol based couplers of the oxygen atom elimination type disclosed in U.S. Pat. Nos. 4,052,212, 4,146,396, 4,228,233 and 4,296,200. Actual examples of phenol based couplers have been disclosed in U.S. Pat. Nos. 2,369,929, 2,801,171, 2,772,162, 2,895,826, etc. Furthermore, the use of the phenol based cyan couplers which have an alkyl group consisting of an ethyl or larger group in the meta position of the phenol ring disclosed in U.S. Pat. No. 3,772,002, the 2,5-diacylamino substituted phenol based couplers disclosed in U.S. Pat. Nos. 2,772,162, 3,758,308, 4,126,396, 4,334,011 and 4,327,173, in West German Patent Laid Open No. 3,329,729, and in Japanese Patent Application No. 42,671/83, etc., and the phenol based couplers which have a phenylureido group in the 2-position and an acylamino group in the 5-position disclosed in U.S. Pat. Nos. 3,446,622, 4,333,999, 4,451,559 and 4,427,767, etc. is preferred in this invention.

The most desirable cyan couplers for use in the invention are those which can be represented by the general formulae (C-I) and (C-II) which are indicated below.

General Formula (C-I)

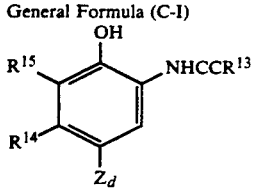

In this formula, $R^{13}$ represents an alkyl group, aryl group, amino group or heterocyclic group. $R^{14}$ represents an acylamino group Or an alkyl group. $R^{15}$ represents a hydrogen atom, halogen atom, alkyl group or an alkoxy group. Furthermore, $R^{15}$ and $R^{14}$ may be joined together to form a ring. $Z^d$ represents a hydrogen atom or a group which can be eliminated in a reaction with the oxidized form of a primary aromatic amine color developing agent.

More precisely, the alkyl groups represented by $R^{13}$ in general formula (C-I) are preferably linear chain, branched chain or cyclo alkyl groups which have from 1 to 32 carbon atoms, and the aryl groups represented by $R^{13}$ are preferably aryl groups which have from 6 to 42 ( carbon atoms. When $R^{13}$ represents an amino group it may be an alkyl amino or aryl amino group, but it is preferably a phenylamino group which may have substituent groups. The alkyl groups, aryl groups and phenylamino groups represented by $R^{13}$ may have substituent groups selected from among the alkyl groups, aryl groups, alkyloxy or aryloxy groups, carboxyl group, alkyl or aryl carbonyl groups, alkyl or aryl oxycarbonyl groups, acyloxy groups, sulfamoyl groups, carbamoyl groups, sulfonamido group, acylamino groups, imido groups, sulfonyl groups, hydroxyl group, cyano group and the halogen atoms. When $R^{15}$ and $R^{14}$ are joined together and form a ring, the ring so formed is a five to seven membered ring, and oxyindole rings, 2-oxobenzoimidazoline rings or carbostyril rings etc. are preferred.

$Z^d$ represents a hydrogen atom or a coupling leaving group. Examples of coupling leaving groups include halogen atoms, alkoxy groups, aryloxy groups, acyloxy groups, sulfonyloxy groups, amido groups, alkoxycarbonyloxy groups, aryloxycarbonyloxy groups, aliphatic, aromatic or heterocyclic thio groups, imido groups, N-heterocyclic groups, aromatic azo groups, etc These leaving groups may contain photographically useful groups.

Dimers or larger oligomers may be formed via $R^{13}$, $R^{14}$ or $Z^d$ in the general formula (C-I).

General Formula (C-II)

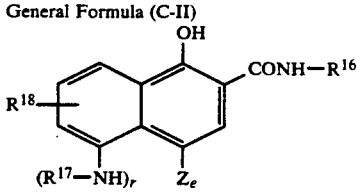

In this formula, $R^{16}$ represents an alkyl group, an aryl group or a heterocyclic group, $R^{17}$ represents an acyl group, sulfonyl group, alkoxycarbonyl group, or an alkoxysulfonyl group, $R^{18}$ represents a hydrogen atom, halogen atom, alkyl group, alkoxy group, aryloxy group, amido group, imido group, alkylthio group, arylthio group, ureido group, alkylsulfonyl group or an arylsulfonyl group, and p represents 0 or 1. $Z_e$ represents a hydrogen atom or a group which can be eliminated in a reaction with the oxidized form of a primary aromatic amine color developing agent.

More precisely, the alkyl groups represented by $R^{16}$ in general formula (C-II) are preferably linear chain, branched chain or cyclo alkyl groups which have from 1 to 32 carbon atoms, the aryl groups represented by $R^{16}$ are preferably aryl groups which have from 6 to 42 carbon atoms, and heterocyclic groups are four to seven membered rings which contain at least one oxygen atom, nitrogen atom or sulfur atom, and these may be substituted with the substituent groups described for the alkyl groups of $R^{13}$ in general formula (C-I). $Z_e$ represents a hydrogen atom or a coupling leaving group, and it represents the same leaving groups as $Z^d$ in general formula (C-I). Dimers or larger oligomers can be formed via $R^{16}$, $R^{17}$, $R^{18}$ or $Z_e$ in general formula (C-II).

Actual examples of cyan couplers which can be represented by the aforementioned general formulae (C-I) and (C-II) are indicated below, but the invention is not limited to these examples.

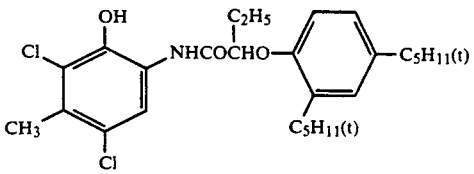

(C-1)

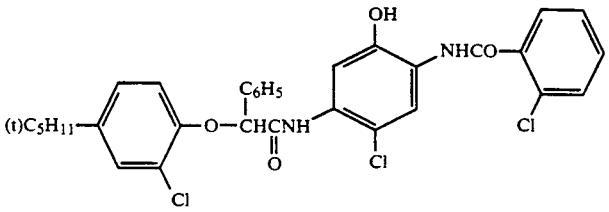

(C-2)

-continued (C-3)

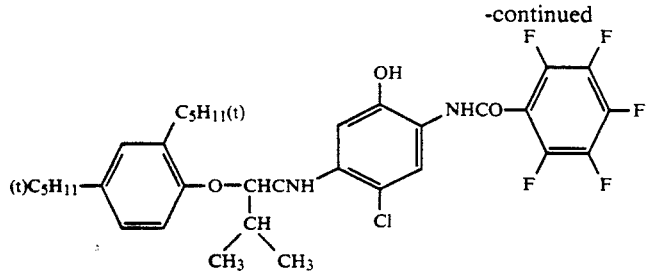

(C-4)

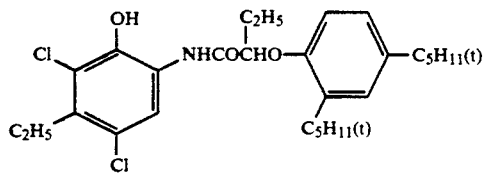

(C-5)

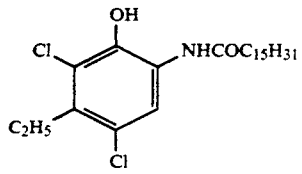

(C-6)

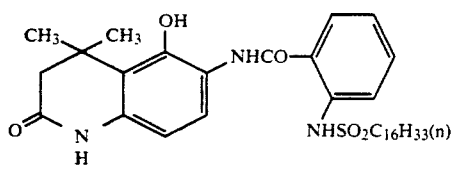

(C-7)

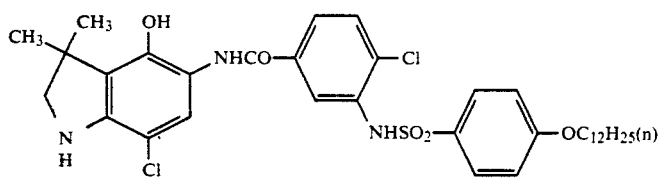

(C-8)

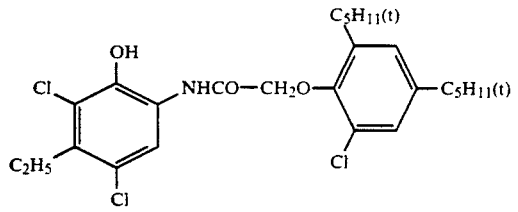

(C-9)

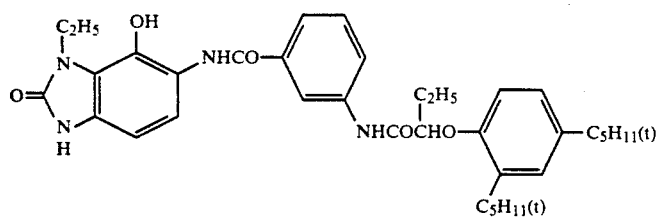

The oil protected type acylacetamide based couplers are typical of the yellow couplers which can be used in the invention. Actual examples have been disclosed in U.S. Pat. Nos. 2,407,210, 2,875,057, 3,265,506, etc. The use of two-equivalent yellow couplers is preferred in this invention, and typical examples include the yellow couplers of the oxygen atom elimination type disclosed in U.S. Pat. Nos. 3,408,194, 3,447,928, 3,933,501, 4,022,620, etc. and the nitrogen atom elimination type yellow couplers disclosed in JP-B-58-10739, in U.S. Pat. Nos. 4,401,752 and 4,326,024, in *Research Disciosure* 18053 (April 1979), in British Patent No. 1,425,020, and in West German Patent Application Laid Open Nos. 2,219,917, 2,261,361, 2,329,587, 2,433,812, etc. The α-pivaloylacetanilide based couplers are excellent in terms of the fastness, especially the light fastness, of the colored dye, while the α-benzoylacetanilide based couplers provide high color densities.

The most desirable yellow couplers for use in the invention are those which can be represented by the general formulae (Y-I) and (Y-II) which are indicated below.

General formula (Y-I)

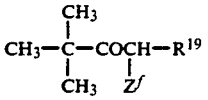

In this formula, $R^{19}$ represents a substituted or unsubstituted N-phenylcarbamoyl group, and $Z^f$ represents a group which can be eliminated in a reaction with the oxidized form of a primary aromatic amine developing agent.

More precisely, the substituent groups on the phenyl ring of the N-phenylcarbamoyl group represented by $R^{19}$ in general formula (Y-I) are aliphatic groups, heterocyclic groups, aliphatic oxy groups, aromatic oxy groups, acyl groups, ester groups, amido groups, imido groups, ureido groups, aliphatic or aromatic sulfonyl groups, or aliphatic or aromatic thio groups, and when there are two or more groups they may be the same or different. $Z^f$ in general formula (Y-I) represents a coupling leaving group, and examples include halogen atoms, alkoxy groups, aryloxy groups, acyloxy groups, sulfonyloxy groups, amido groups, alkoxycarbonyloxy groups, aryloxycarbonyloxy groups, aliphatic or aromatic thio groups, imido groups, N-heterocyclic groups, aromatic azo groups, etc., but the N-heterocyclic groups are preferred from the point of view of high activity. These leaving groups may contain photographically useful groups.

Dimers or larger oligomers can be formed via $R^{19}$ or $Z^f$ in general formula (Y-I).

General Formula (Y-II)

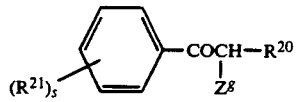

In this formula, $R^{20}$ represents a substituted or unsubstituted N-phenylcarbamoyl group, $Z^g$ represents a group which can be eliminated in a reaction with the oxidized form of a primary aromatic amine color developing agent, $R^{21}$ represents a hydrogen atom or a substituent group, and s represents an integer of value from 1 to 5.

$R^{20}$ and $Z^g$ in general formula (Y-II) have the same significance as $R^{19}$ and $Z^f$ in general formula (Y-I), and the substituent groups represented by $R_{21}$ are the same as those defined for the phenyl group of the N-phenylcarbamoyl group of $R^{19}$ in general formula (Y-I).

Dimers or larger oligomers can be formed via $R^{20}$, $Z^g$ or $R^{21}$ in general formula (Y-II).

Actual examples of yellow couplers which can be represented by the aforementioned general formulae (Y-I) and (Y-II) are indicated below, but the invention is not limited to these examples.

(Y-1)

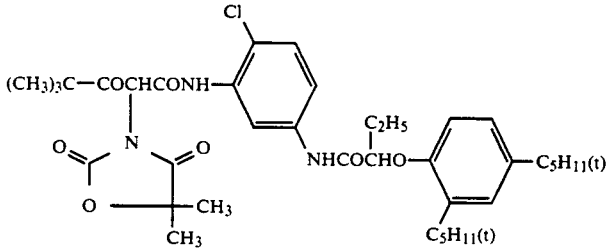

(Y-2)

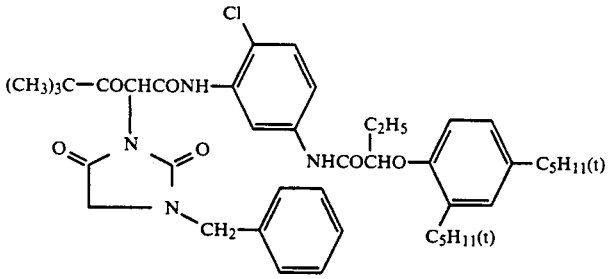

(Y-3)

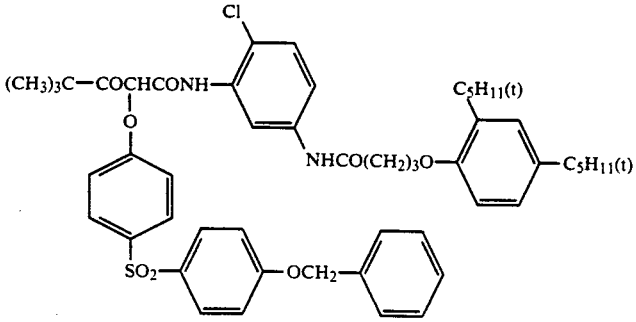

-continued
(Y-4)
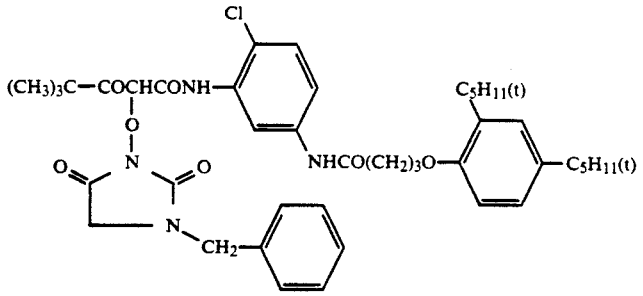
(Y-5)
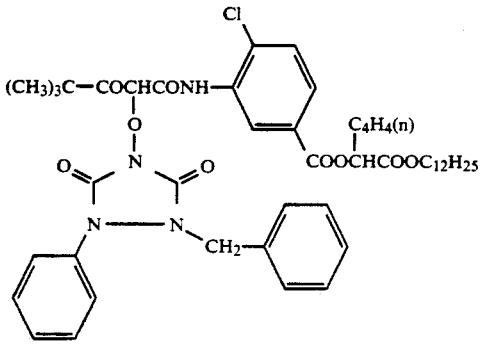
(Y-6)
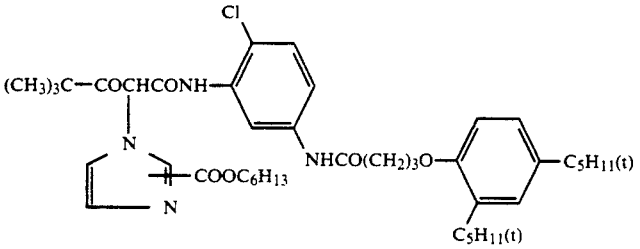
(Y-7)
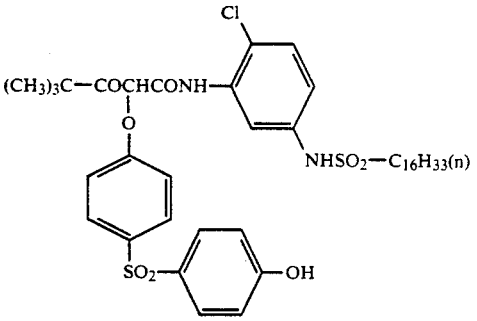
(Y-8)
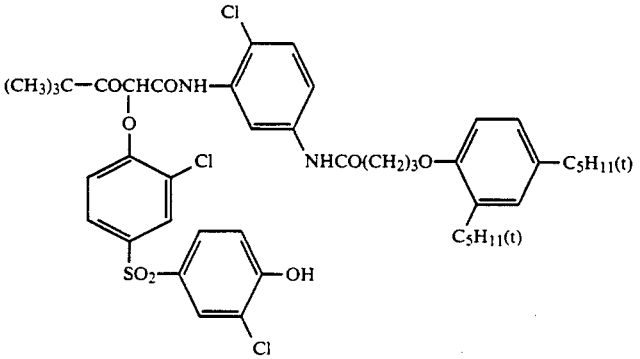

-continued (Y-9)

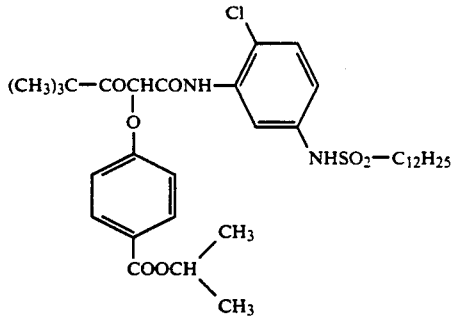

Dispersions of fine lipophilic particles which contain coupler, high boiling point coupler solvent and polymer of this invention are typically prepared in the way indicated below.

The polymer of this invention, which is a so-called linear polymer which is uncrosslinked and which has been prepared by solution polymerization, emulsion polymerization or suspension polymerization, etc., the high boiling point coupler solvent and the coupler are formed into a complete solution, together with an auxiliary solvent, after which the solution is dispersed, with the aid of a dispersing agent, with ultrasonic waves or in a colloid mill, in water, preferably in an aqueous solution of a hydrophilic colloid, and most desirably in an aqueous gelatin solution, to form fine particles, and this is included in the silver halide emulsion. Alternatively, water or an aqueous hydrophilic colloid solution such as a gelatin solution may be added to an auxiliary organic solvent which contains a dispersion promotor such as a surfactant, the polymer of this invention, the high boiling point coupler solvent and the coupler, and an oil in water dispersion may be formed by phase reversal. The auxiliary organic solvent, is then removed by volatalization, noodle washing or ultrafiltration, etc. from the dispersion which has been prepared in this way, after which the dispersion may be mixed with the photographic emulsion. The term "auxiliary organic solvent" as used herein signifies an organic solvent which is useful at the time of emulsification and dispersion, being a low boiling point organic solvent which is ultimately eliminated from the photosensitive material in practice during the course of drying at the time of coating or in the ways indicated above, or a solvent which has a certain degree of solubility in water and which can be removed by washing with water. The auxiliary solvent may be a lower alcohol acetate such as ethyl acetate or butyl acetate, ethyl propionate, sec-butyl alcohol, methyl ethyl ketone, methyl isobutyl ketone, β-ethoxyethyl acetate, methylcellosolve acetate, methylcarbitol acetate, methylcarbitol propionate, cyclohexanone, etc.

Moreover, some organic solvent which is completely miscible with water, for example, methyl alcohol, ethyl alcohol, acetone, tetrahydrofuran, etc., can be used conjointly, as desired.

Combinations of two or more of those organic solvents can be used.

The use of anionic surfactants such as alkylbenzene sulfonic acids and alkylnaphthalene sulfonic acids and/or non-ionic surfactants such as sorbitane sesquioleic acid esters and sorbitane monolauric acid esters etc. as the above mentioned surfactants is preferred.

The average particle size of the fine lipophilic particles obtained in this way is preferably within the range from 0.04μ to 2μ and, most desirably, the average particle size is within the range from 0.06μ to 0.4μ. The particle diameter of the fine lipophilic particles can be measured with a measuring device such as the "Nanosizer" made by the British Coal Tar Co.

Silver bromide, silver iodobromide, silver iodochlorobromide, silver chlorobromide and silver chloride can all be used as the silver halide in this invention. The use of silver chlorobromides of which the silver chloride content is at least 90 mol % (and preferably at least 98 mol %) is especially desirable in cases where rapid processing is intended.

The silver chlorobromide may contain a little silver iodide, but the absence of silver iodide is preferred.

The average grain size (the grain diameter in the case of spherical grains or grains which approach a spherical form or the length of an edge in the case of cubic grains is taken for the grain size, the average being expressed on the basis of the projected areas) of the silver halide grains in the photographic emulsion is of no particular importance, but it is preferably not more than 2 μm and, most desirably, it is within the range from 0.2 to 1.5 μm.

The silver halide grains in the photographic emulsion layer may have a regular crystalline form, such as a cubic, tetradecahedral or octahedral form, (being a regular crystalline emulsion), or they may have an irregular crystalline form, such as a spherical or plate like form, or they may have a composite form consisting of these crystalline forms. They may also take the form of mixtures of grains of various crystalline forms. Of these, the use of the aforementioned regular emulsions is preferred.

Emulsions in which tabular silver halide grains of which the diameter is at least 5 times the thickness account for at least 50 mol % of the total projected area can also be used.

The silver halide emulsion which is included in at least one photosensitive layer is preferably a mono-disperse emulsion of which the coefficient of variation (the value obtained by dividing the statistical standard deviation by the average grain size expressed as a percentage) is not more than 15%, and most desirably not more than 10%.

Mono-disperse emulsions of this type may be independent emulsions which have a coefficient of variation as mentioned above, but they may be emulsions in which two or more mono-disperse emulsions which have been prepared separately and of which the average grain size in each case has a coefficient of variation of not more than 15%, and preferably not more than 10%, are mixed together.

The difference in grain size and the mixing ratio is not limited, but the use of emulsions of which the average grain size difference is within the range from at least 0.2 μm but not more than 1.0 μm is preferred.

The definition of the variation coefficient referred to above, and methods for its measurement, have been described by T. H. James on page 39 of "The Theory of the Photographic Process", Third Edition, published by the Macmillan Co. (1966).

The silver halide grains may have different phases for the internal part and the surface layer. Furthermore, they may be of the type with which the latent image is formed principally at the surface of the grains or of the type with which the latent image is formed principally within the grains. Grains of the latter type are especially useful for direct positive emulsions.

Cadmium salts, zinc salts, thallium salts, lead salts, iridium salts or complex salts thereof, rhodium salts or complex salts thereof, iron salts or complex salts thereof, etc. may also be present during the formation or physical ripening process of the silver halide grains.

Silver halide emulsions are normally subjected to chemical sensitization. The usual methods of chemical sensitization can be used, and details have been disclosed from line 18 of the lower left hand column of page 12 to line 16 on the lower right hand column on page 12 of the specification of JP-A-62-215272.

Furthermore, the silver halide emulsions are normally subjected to spectral sensitization. The usual methine dyes can be used for the spectral sensitization, and details have been disclosed between line 3 from the bottom of the upper right hand column on page 22 and page 38 of the specification of JP-A-62-215272, and on separate page (B) of the Procedural Amendment dated 16th March 1987 attached thereto.

Various compounds can be included in the photographic emulsions which are used in the invention with a view to preventing the occurrence of fogging during the manufacture, storage or photographic processing of the photosensitive material, or with a view to stabilizing photographic performance. Thus many compounds which are known as anti-fogging agents or stabilizers, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially 1-phenyl-5-mercaptotetrazole, etc.), mercaptopyrimidines; mercaptotriazines, etc.; thioketo compounds such as, for example, oxazolinethione; azaindenes, for example, triazaindenes, tetra-azaindenes (especially 4-hydroxy substituted (1,3,3a,7)tetra-azaindene), penta-azaindenes, etc ; benzenethiosulfonic acid, benzenesulfinic acid, benzenesulfonic acid amide, etc., can be added for this purpose.

The photosensitive materials of this invention may contain hydroquinone derivatives, aminophenol derivatives, amines, gallic acid derivatives, catechol derivatives, ascorbic acid derivatives, colorless couplers, sulfonamidophenol derivatives, etc. as anti-color fogging agents or anti-color mixing agents.

Various anti-color fading agents can also be used in the photosensitive materials of this invention. That is to say, typical examples of organic anti-color fading agents which can be used for cyan, magenta and/or yellow images include hydroquinones, 6-hydroxychromans, 5-hydroxycoumarans, spirochromans, p-alkoxyphenols, hindered phenols centered on the bisphenols, gallic acid derivatives, methylenedioxybenzenes, aminophenols, and hindered amines, and ether and ester derivatives in which the phenolic hydroxyl groups of these compounds have been silylated or alkylated. Furthermore, metal complexes typified by the (bis-salicylaldoxymato)nickel complex and the (bis-N,N-dialkyldithiocarbamato)nickel complex can be used for this purpose.

Actual examples of organic anti-color fading agents have been disclosed in the specifications of the following patents:

Hydroquinones have been disclosed in U.S. Pat. Nos. 2,360,290, 2,415,613, 2,700,453, 2,701,197, 2,725,659, 2,732,300, 2,735,765, 3,952,944 and 4,430,425, in British Patent No. 1,363,921, and in U.S. Pat. Nos. 2,710,501 and 2,516,025, etc., 6-hydroxychromans, 5-hydroxycoumarans and spirochromans have been disclosed in U.S. Pat. Nos. 3,432,300, 3,573,050, 3,574,627, 3,695,909 and 3,764,337, and in JP-A-52-152225, etc., spiroindanes have been disclosed in U.S. Pat. No. 4,360,589, p-alkoxyphenols have been disclosed in U.S. Pat. No. 2,735,765, in British Patent No. 2,066,975, in JP-A-59-10539, and in JP-B-57-19764, etc., hindered phenols have been disclosed in U.S. Pat. No. 3,700,455, in JP-A-52-72225, in U.S. Pat. No. 4,225,235, and in JP-B-52-6623, etc., gallic acid derivatives, methylenedioxybenzenes and aminophenols have been disclosed in U.S. Pat. Nos. 3,457,079 and 4,332,556, and in JP-B-56-21144, respectively, hindered amines have been disclosed in U.S. Pat. Nos. 3,336,351 and 4,265,593, in British Patent Nos. 1,326,559, 1,354,315 and 1,410,546, in JP-B-51-1420 and in JP-A-58-114036, JP-A-59-53846 and JP-A-59-78344, etc., ether and ester derivatives of phenolic hydroxyl groups have been disclosed in U.S. Pat. Nos. 4,155,765, 4,174,220, 4,254,216 and 4,264,720, in JP-A-54-145530, JP-A-55-6321, JP-A-58-105147 and JP-A-59-10539, in JP-B-57-37856, in U.S. Pat. No. 4,279,990, and in JP-B-53-3263, etc., and metal complexes have been disclosed in U.S. Pat. Nos. 4,050,935 and 4,241,155, and in British Patent No. 2,027,731(A), etc. These compounds can be used to achieve the intended purpose by coemulsification with the couplers and addition to the photosensitive layer, normally at a rate of from 5 to 100 wt. % with respect to the corresponding coupler.

The introduction of ultraviolet absorbers into layers on either side adjacent to the cyan color forming layer is more effective for preventing deterioration of the cyan dye image by heat and, more especially, by light.

The spiroindanes and the hindered amines are especially effective among the above mentioned anti-color fading agents. Furthermore, the use of compounds of the type indicated below, together with the aforementioned couplers, and especially together with the pyrazoloazole couplers, is desirable in this invention.

Thus, the concurrent or independent use of a compound (A) which bonds chemically with aromatic amine based developing agents which are left behind after color development processing and which forms a compound which is chemically inert and which is essentially colorless, and/or a compound (B) which bonds chemically with the oxidized form of aromatic amine based color developing agents which are left behind after the color development process and which forms a compound which is chemically inert and which is essentially colorless, is desirable for preventing the occurrence of staining and other side effects due to colored .dye formation resulting from reaction between the coupler and the color developing agent or the oxidized form thereof which is left behind in the film during the storage of the material after processing for example.

The preferred compounds (A) are those which react with p-anisidine in such a way that the second order reaction rate constant $k_2$ (in trioctyl phosphate at 80° C.) is within the range from 1.0 to $1\times10^{-5}$ l/mol sec. The second order reaction rate constant $k_2$ is obtained by a method disclosed in JP-A-63-158545.

When the value of $k_2$ is above this range the compound itself is unstable and it will react with gelatin or water and is inevitably degraded. On the other hand, if the value of $k_2$ is below this range the reaction with the residual aromatic amine based developing agent is slow and it is impossible to prevent the side effects of the residual aromatic amine developing agent from occurring, which is to say that it is impossible to achieve the aim of the invention.

The compounds which can be represented by the general formula (AI) and (AII) which are indicated below are the preferred compounds (A) of this type.

General Formula (AI)

$$R_{22}-(A)_n-X$$

$$R_{23}-\underset{\underset{B}{|}}{C}=Y \qquad \text{General Formula (AII)}$$

In these formulae, $R_{22}$ and $R_{23}$ each represent an aliphatic group, an aromatic group or a heterocyclic group. Moreover, n represents a value of 1 or 0. A represents a group forming a chemical bond by reacting with an aromatic amino developing agent; X represents a group being released by reacting with an aromatic amino developing agent; B represents a hydrogen atom, aliphatic group, aromatic group, heterocyclic group, acyl group or a sulfonyl group, and Y represents a group accelerating the addition of an aromatic amino developing agent to the compound of formula ($A_{II}$). Said $R^{22}$ and X, or said Y and $R^{23}$ or B may be combined with each other to form a cyclic structure.

In the system of causing chemical bonding with a residual aromatic amino developing agent, a typical system is a substitution reaction and an addition reaction.

Specific examples of the preferred compounds shown by aforesaid formulae ($A_I$) and ($A_{II}$) are described in JP-A-63-158545 and 62-283338, Japanese Patent Application No. 62-158342, and Ep-A-277,589.

On the other hand, the compound (B) forming a chemically inactive and colorless compound by causing chemical bonding with the oxidation product of an aromatic amino developing agent remaining after color development is more preferably shown by following formula ($B_I$);

$$R-Z \qquad (B_I)$$

wherein R represents an aliphatic group, an aromatic group or a heterocyclic group and Z represents a nucleophilic group or a group releasing a nucleophilic group by being decomposed in the photographic material.

In the compound shown by formula ($B_I$), Z is preferably a group having the Pearson's nucleophilic $nCH_3I$ value (R. G. Pearson, et al., *Journal of Americal Chemical Society,* 90, 319 (1968)) of at least 5 or a group induced from such a group.

Practical examples of the preferred compounds shown by formula ($B_I$) are described in EP-A-255,722, and 277,589, JP-A 62-143048 and 62-229145, Japanese patent Application Nos. 63-136724, 62-214681, and 62-158342.

Also, the details of the combination of the aforesaid compound (A) and compound (B) are described in EP-A-277,589.

Actual examples of compounds which can be represented by the general formulae ($A_I$) and ($A_{II}$) have been disclosed in Japanese Patent Application Nos. 158,342/87, 158,643/87, 212,258/87, 214,681/87, 228,034/87 and 279,843/87.

Actual examples of the aforementioned anti-staining agents and other image stabilizers are indicated below.

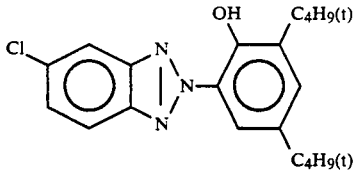

(X-1)

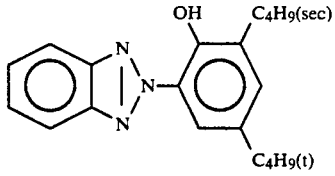

(X-2)

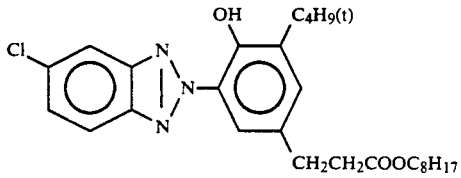

(X-3)

-continued
(X-4)
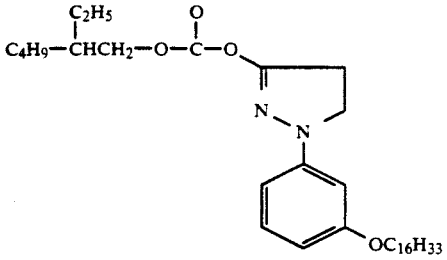
(X-5)
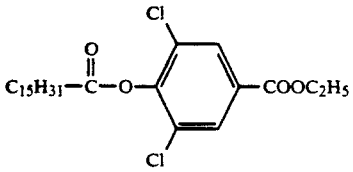
(X-6)
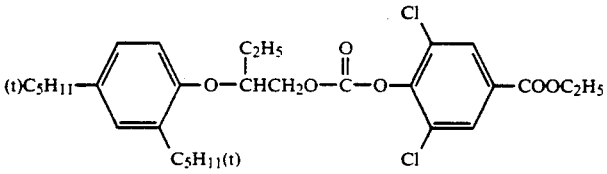
(X-7)
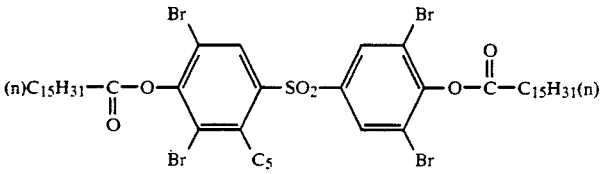
(X-8)
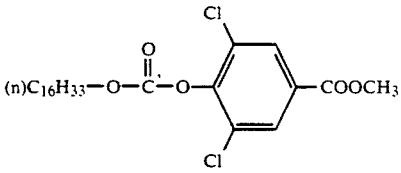
(X-9)
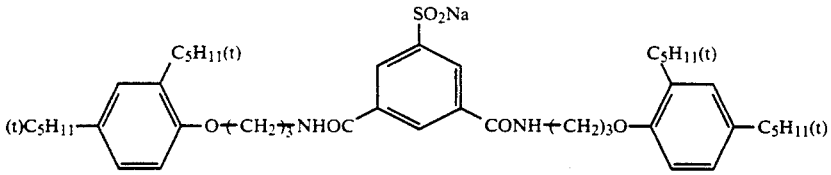
(X-10)
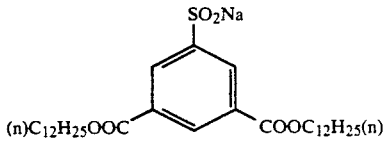
(X-11)
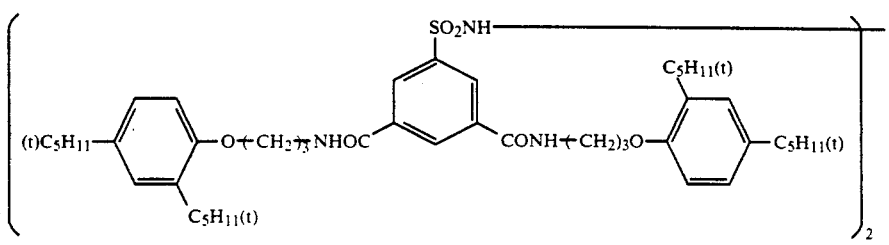

-continued

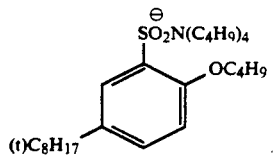

(X-12)

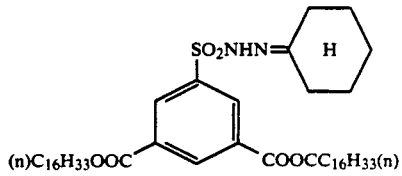

(X-13)

Ultraviolet absorbers can be included in the hydrophilic colloid layers of the photosensitive materials of this invention. For example, use can be made of the benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzo-oxidol compounds (for example, those disclosed in U.S. Pat. No. 3,700,455). Ultraviolet absorbing couplers (for example, the α-naphthol based cyan dye forming couplers) or ultraviolet absorbing polymers, etc. can also be used for this purpose. These ultraviolet absorbers may be mordanted into a specified layer.

Water soluble dyes can be included in the hydrophilic colloid layers of the photosensitive materials of this invention as filter dyes or for anti-irradiation and various other purposes. Dyes of this type include oxonol dyes, hemi-oxonol dyes, styryl dyes, merocyanine dyes, cyanine dyes and azo dyes. Of these dyes, the oxonol dyes, hemi-oxonol dyes and merocyanine dyes are useful. Details of useful oxonol dyes have been described from the upper right column on page 158 to page 163 of the specification of JP-A-62-215272.

The use of gelatin is convenient as the binding agent or protective colloid in the emulsion layers of photosensitive materials of this invention, but other hydrophilic colloids can be used either independently or in conjunction with gelatin.

The gelatin used in the invention may be a lime treated gelatin, or a gelatin which has been treated with acid can be used. Details of the manufacture of gelatin have been described by Arthur Wiese in "The Macromolecular Chemistry of Gelatin" (published by Academic Press, 1964).

The cellulose nitrate films, cellulose acetate films, cellulose acetate butyrate films, cellulose acetate propionate films, polystyrene films, polyethylene-terephthalate films, polycarbonate films, laminates of these films with other materials, thin glass films, paper, etc. normally used in photographic materials can be used for the support which is used in this invention. Supports such as papers which have been coated or laminated with baryta or an α-olefin polymer, especially a polymer made from an α-olefin which has from 2 to 10 carbon atoms, for example, polyethylene, polypropylene, ethylene/butene copolymer etc., vinyl chloride resins which contain reflecting substances such as $TiO_2$, and plastic films of which the adhesion with other polymeric materials has been improved by surface roughening as described in JP-B-47-19068 provide good results. Furthermore, ultraviolet curable resins can be used for this purpose.

A transparent support or a non-transparent support can be selected according to the intended purpose of the photosensitive material. Furthermore, the supports can be rendered colored and transparent by the addition of dyes or pigments.

Apart from the original non-transparent supports such as paper, non-transparent supports also include those made by adding dyes or organic pigments, such as titanium oxide, to a transparent film, and plastic films which have been surface treated using methods such as those described in JP-B-47-19068, etc. An underlayer is normally established on the support. Preliminary surface treatments such as corona discharge treatments, ultraviolet irradiation and flame treatments, etc. can also be used with these supports in order to improve their adhesion properties.

The color photosensitive materials which can be used for making color photographs of this invention may be any of the usual types of color photographic materials, for example, color negative films, color papers, reversal color papers, color reversal films etc., and they are especially suitable for color photosensitive materials intended for printing purposes.

Black and white development baths and/or color development baths can be used for the development processing of the photosensitive materials of this invention. A color development bath preferably consists of an aqueous alkaline solution which contains a primary aromatic amine based color developing agents, as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-- ethyl-N-β-methoxyethylaniline and the sulfate, hydrochloride and p-toluenesulfonate salts of these compounds. Two or more of these compounds can be used conjointly, depending on the intended purpose.

The color development baths generally contain pH buffers such as alkali metal carbonates, borates or phosphates, and development inhibitors or anti-fogging agents such as bromides, iodides, benzimidazoles, benzothiazoles or mercapto compounds. They may also contain, as required, various preservatives such as hydroxylamine, diethylhydroxylamine, sulfites, hydrazines, phenylsemicarbazides, triethanolamine, catechol sulfonic acids, triethylenediamine(1,4-diazabicyclo[2,2,-2]octane), etc., organic solvents such as ethyleneglycol and diethyleneglycol, development accelerators such as benzyl alcohol, poly(ethyleneglycol), quaternary ammonium salts and amines, dye forming couplers, competitive couplers, fogging agents such as sodium borohydride, auxiliary developing agents such as 1-phenyl-3-pyrazolidone, viscosity imparting agents, and various chelating agents as typified by the aminopolycarboxylic acids, aminopolyphosphonic acids, alkylphosphonic acids and phosphonocarboxylic acids, typical examples of which include ethylenediamine tetra-acetic acid, nitrilo triacetic acid, diethylentriamine penta-acetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine di(o-hydroxyphenylacetic acid), and salts of these compounds.

Color development is carried out after a normal black and white development in the case of reversal processing. The known black and white developing agents, for example, dihydroxybenzenes such as hydroquinone, etc., 3-pyrazolidones such as 1-phenyl-3-pyrazolidone, etc., and aminophenols such as N-methyl-p-aminophenol, etc., can be used individually or in combinations for the black and white development bath.

The pH of these color development and black and white development baths is generally within the range from 9 to 12. Furthermore, the replenishment rate of these development baths depends on the color photographic material which is being processed, but it is generally not more than 3 liters per square meter of photosensitive material and it is possible, by reducing the bromide ion concentration in the replenisher, to use a replenishment rate of not more than 500 ml per square meter of photosensitive material. Prevention of the loss of liquid by evaporation, and aerial oxidation, by minimizing the contact area with the air in the processing tank is desirable in cases where the replenishment rate is low. Furthermore, the replenishment rate can be reduced by using a means of suppressing the accumulation of bromide ion in the developer.

The photographic emulsion layers are subjected to a normal bleaching process after color development. The bleaching process may be carried out at the same time as the fixing process (in a bleach-fix process) or it may be carried out as a separate process. Moreover, a bleach-fix process can be carried out after a bleaching process in order to speed-up processing. Moreover, processing can be carried out in two connected bleach-fix baths, a fixing process can be carried out before carrying out a bleach-fix process, or a bleaching process can be carried out after a bleach-fix process, according to the intended purpose of the processing. Compounds of a poly-valent metal such as iron(III), cobalt(III), chromium(VI), copper(II), etc., peracids, quinones, nitro compounds, etc. can be used as bleaching agents. Typical bleaching agents include ferricyanides; dichromates; organic complex salts of iron(III) or cobalt(III), for example, complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid, glycol ether diamine tetra-acetic acid, etc., or citric acid, tartaric acid, malic acid, etc.; persulfates; bromates; permanaganates; and nitrobenzenes, etc. Of these materials the use of the aminopolycarboxylic acid iron(III) complex salts, principally ethylenediamine tetra-acetic acid iron(III) complex salts, and persulfates, is preferred from the points of view of both rapid processing and the prevention of environmental pollution. Moreover, the amino polycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but processing can be carried out at lower pH values in order to speed-up processing.

Bleach accelerators can be used, as required, in the bleach baths, bleach-fix baths, or bleach or bleach-fix pre-baths. Actual examples of useful bleach accelerators have been disclosed in the following specifications: Thus there are the compounds which have a mercapto group or a disulfide group disclosed in U.S. Pat. No. 3,893,858, West German Patent Nos. 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, and in *Research Disclosure* No. 17,129 (July 1978), etc.; the thiazolidine derivatives disclosed in JP-A-50-140129; the thiourea derivatives disclosed in JP-B-45-8506, in JP-A-52-20832 and JP-A-53-32735, and in U.S. Pat. No. 3,706,561; the iodides disclosed in West German Patent No. 1,127,715 and in JP-A-58-16235; the polyoxyethylene compounds disclosed in West German Patent Nos. 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ions, etc. Among these compounds, those which have a mercapto group or a disulfide group are preferred in view of their large accelerating effect, and the use of the compounds disclosed in U.S. Pat. No. 3,893,858, in West German Patent No. 1,290,812, and in JP-A-53-95630 is especially desirable. Moreover, the use of the compounds disclosed in U.S. Pat. No. 4,552,834 is also desirable. These bleach accelerators may be added to the sensitive material, and they are especially effective when bleach-fixing camera color photosensitive materials.

Thiosulfates, thiocyanates, thioether based compounds, thioureas and large quantities of iodides, etc. can be used as fixing agents, but thiosulfates are generally used for this purpose, and ammonium thiosulfate in particular can be used in the widest range of applications. Sulfites or bisulfites, or carbonyl-bisulfite addition compounds, are preferred as preservatives for bleach-fix baths.

The silver halide color photographic materials of this invention are generally subjected to a water washing and/or stabilizing process after the desilvering process. The quantity of water used in the water washing process can be established within a wide range according to the nature of the photosensitive material (for example, the materials, such as the couplers, which are being used), the wash water temperature, the number of washing tanks (the number of washing stages), the replenishment system, i.e. whether a counter-flow or a sequential-flow system is used, and various other conditions. The relationship between the quantity of water used and the number of water washing tanks in a multi-stage counter-flow system can be obtained using the method outlined on pages 248-253 of Journal of the Society of Motion Picture and Television Engineers, Volume 64 (May 1955).

The amount of wash water can be greatly reduced by using the multi-stage counter-flow system noted in the aforementioned literature, but bacteria proliferate due to the increased residence time of the water in the tanks and problems arise as a result of the sediments which are formed becoming attached to the photosensitive material. The method in which the calcium ion and manganese ion concentrations are reduced as disclosed in Japanese Patent Application No. 61-131632 can be used very effectively to overcome problems of this sort in the processing of color photosensitive materials of this invention. Furthermore, the iso-thiazolone compounds and thiabendazoles disclosed in JP-A-57-8542 and the chlorine based disinfectants such as chlorinated sodium isocyanurate, and benzotriazoles, etc., and the disinfectants disclosed in "Chemistry of Biocides and Fungicides" by Horiguchi, "Reduction of Microorganisms, Biocidal and Fungicidal Techniques", published by the Health and Hygiene Technical Society and in "A Dictionary of Biocides and Fungicides", published by the Japanese Biocide and Fungicide Society, can be used for this purpose.

The pH value of the wash water used when processing photosensitive materials of invention is within the range from 4 to 9, and preferably within the range from 5 to 8. The wash water temperature and the washing time can be set variously according to the nature of the photosensitive material and the application, etc. but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water washing process as described above. The known methods disclosed in JP-A-57-8543, JP-A-58-14834 and JP-A-60-220345 can all be used for this purpose.

Furthermore, there are cases in which a stabilizing process is carried out following the aforementioned water washing process, and the stabilizing baths which contain formalin and surfactant which are used as a final bath for camera color photosensitive materials are an example of such a process. Various chelating agents, biocides, etc. can be added to these stabilizing baths.

The overflow which accompanies replenishment of the abovementioned wash water and/or stabilizer can be re-used in other processes such as the desilvering process, etc.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure* Nos. 14,850 and 15,159, the aldol compounds disclosed in *Research Disclosure* No. 13,924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed in JP-A-56-64339, JP-A-57-144547, JP-A-58-115438, etc.

The various processing baths are used at a temperature of from 10° to 50° C. in this invention. The standard temperature is normally from 33° to 38° C., but processing is accelerated and the processing time is shortened at higher temperatures and, conversely, increased picture quality and improved stability of the processing baths can be achieved at lower temperature. Furthermore, processes using hydrogen peroxide intensification or cobalt intensification as disclosed in West German Patent No. 2,226,770 or U.S. Pat. No. 3,674,499 can be carried out in order to economize on silver in the photosensitive material.

Unless otherwise indicated, all parts, proportions, and percentages are by weight

EXAMPLE 1

The multi-layer silver halide photosensitive material 101 of which the layer structure is indicated below was prepared on a paper support which had been laminated on both sides with polyethylene. Moreover, ethyl acetate was used as an auxiliary solvent together with the high boiling point solvent in the coupler solvents mentioned below.

Layer Structure

The composition of each layer is indicated below. The numerical values indicate coated weights (in grams per square meter) In the case of the silver halide emulsions the weight coated is indicated after calculation as silver.

Support

Polyethylene laminated paper (White pigment ($TiO_2$) and ultramarine dye were included in the polyethylene on the first layer side).

| | |
|---|---|
| First Layer (Blue Sensitive Layer) | |
| Mono-disperse silver chlorobromide emulsion (EM1) which had been spectrally sensitized with the sensitizing dye (ExS-1) | 0.16 |
| Mono-disperse silver chlorobromide emulsion (EM2) which had been spectrally sensitized with the sensitizing dye (ExS-2) | 0.10 |
| Gelatin | 1.86 |
| Colored image stabilizer (Cpd-1) | 0.02 |
| Yellow coupler (Y-2) | 0.83 |
| Solvent (S-25) | 0.48 |
| Second Layer (Anti-color Mixing Layer) | |
| Gelatin | 0.99 |
| Anti-color mixing agent (Cpd-3) | 0.03 |
| Solvent (S-9) | 0.10 |
| Third Layer (Green Sensitive Layer) | |
| Mono-disperse silver chlorobromide emulsion (EM3) which had been spectrally sensitized with the sensitizing dye (ExS-2, 3) | 0.05 |
| Mono-disperse silver chlorobromide emulsion (EM4) which had been spectrally sensitized with the sensitizing dye (ExS-2, 3) | 0.11 |
| Gelatin | 1.80 |
| Magenta coupler (m-1) | 0.39 |
| Colored image stabilizer (Cpd-4) | 0.20 |
| Colored image stabilizer (Cpd-5) | 0.01 |
| Colored image stabilizer (Cpd-6) | 0.01 |
| Solvent (S-16) | 0.12 |
| Solvent (S-8) | 0.25 |
| Fourth Layer (Ultraviolet Absorbing Layer) | |
| Gelatin | 1.60 |
| Ultraviolet absorber | 0.70 |

-continued

| | |
|---|---|
| (Cpd-7/Cpd-8/Cpd-9 = 3/2/6 by weight) | |
| Anti-color mixing agent (Cpd-3) | 0.05 |
| Solvent (II-5) | 0.27 |
| Fifth Layer (Red Sensitive Layer) | |
| Mono-disperse silver chlorobromide emulsion (EM5) which had been spectrally sensitized with the sensitizing dye (ExS-4, 5) | 0.07 |
| Mono-disperse silver chlorobromide emulsion (EM6) which had been spectrally sensitized with the sensitizing dye (ExS-4, 5) | 0.16 |
| Gelatin | 0.92 |
| Cyan coupler (C-4) | 0.17 |
| Cyan coupler (C-5) | 0.15 |
| Colored image stabilizer (Cpd-1) | 0.03 |
| Colored image stabilizer (Cpd-5) | 0.01 |
| Colored image stabilizer (Cpd-6) | 0.01 |
| Ultraviolet absorber (Cpd-7/Cpd-9/Cpd-10 = 3/4/2 by weight) | 0.17 |
| Solvent (S-16) | 0.20 |
| Sixth Layer (Ultraviolet Absorbing Layer) | |
| Gelatin | 0.54 |
| Ultraviolet absorber (Cpd-7/Cpd-8/Cpd-9 = 1/5/3 by weight) | 0.21 |
| Anti-color mixing agent (Cpd-3) | 0.02 |
| Solvent (II-5) | 0.06 |
| Seventh Layer (Protective Layer) | |
| Gelatin | 1.33 |
| Acrylic modified copolymer of poly(vinyl alcohol) (17% modification) | 0.17 |
| Liquid paraffin | 0.03 |

Furthermore, Cpd-11 and Cpd-12 were used at this time as anti-irradiation compounds. Moreover, "Alcanol XC" (made by DuPont), sodium alkylbenzenesulfonate, succinic acid ester and "Magafao F-120" (made by Dainippon Ink) were used as emulsification and dispersion, and coating, promotors in each layer. Cpd-13 and Cpd-14 were used as silver halide stabilizers.

Furthermore, 1-oxy-3,5-dichloro-s-triazine, sodium salt, was used as a gelatin hardening agent in each layer, and Cpd-2 was used as a viscosity increasing agent.

Details of the emulsions, used are indicated below.

| Emulsion | Form | Average Grain Size (μm) | Br Content (mol %) | Variation Coefficient |
|---|---|---|---|---|
| EM-1 | Cubic | 0.96 | 80 | 0.06 |
| EM-2 | Cubic | 0.64 | 80 | 0.07 |
| EM-3 | Cubic | 0.52 | 70 | 0.08 |
| EM-4 | Cubic | 0.40 | 70 | 0.09 |
| EM-5 | Cubic | 0.44 | 70 | 0.09 |
| EM-6 | Cubic | 0.36 | 70 | 0.08 |

Coeff. of Variation = Standard Deviation/Average Grain Size

The structural formulae corresponding to the codes used for the above mentioned additives other than the compounds which have been described earlier as illustrative examples are indicated below.

ExS-1

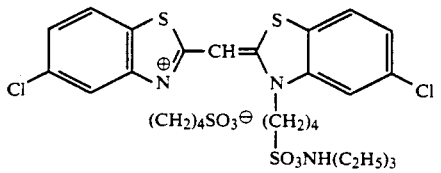

$6 \times 10^{-4}$ mol/mol.Ag

ExS-2

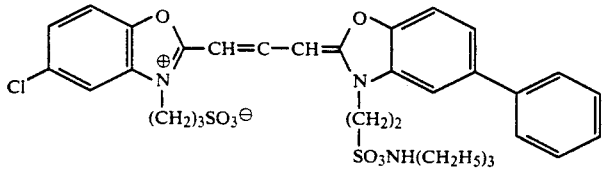

$4 \times 10^{-4}$ mol/mol.Ag

ExS-3

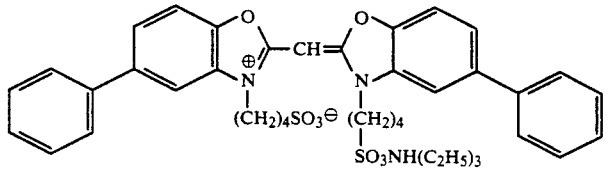

$8 \times 10^{-5}$ mol/mol.Ag

ExS-4

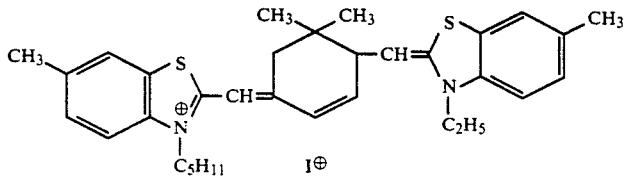

$1.8 \times 10^{-4}$ mol/mol.Ag

-continued
ExS-5
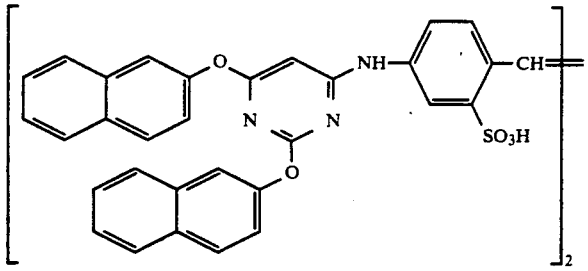
Cpd-1
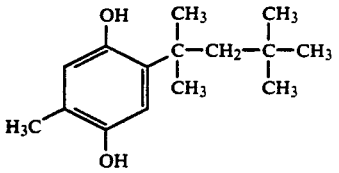
Cpd-2
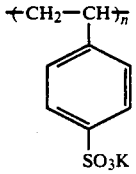
Cpd-3
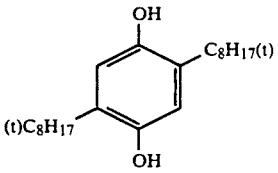
Cpd-4
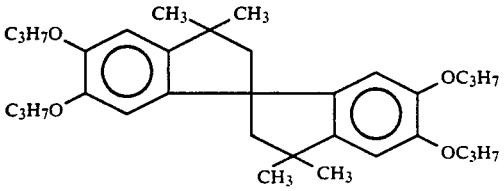
Cpd-5
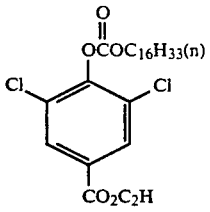
Cpd-6
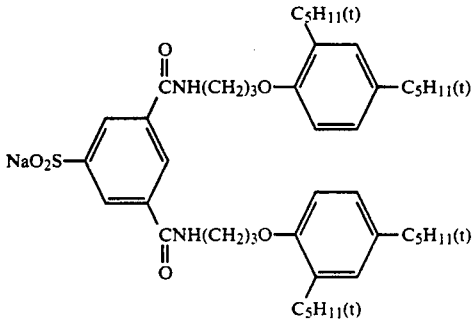

-continued

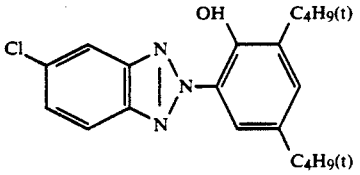

Cpd-7

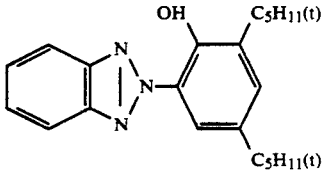

Cpd-8

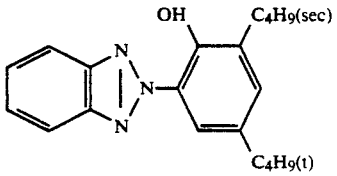

Cpd-9

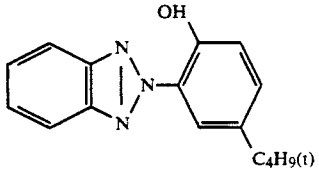

Cpd-10

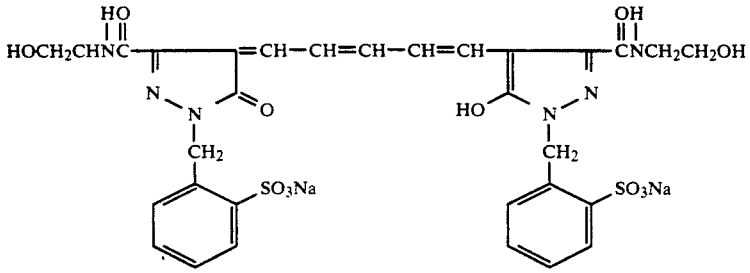

Cpd-11

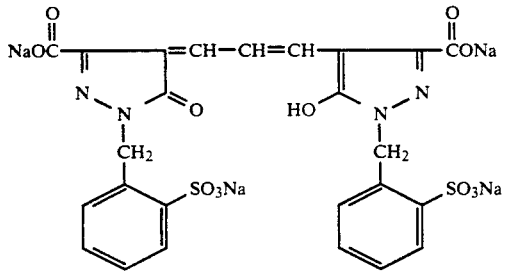

Cpd-12

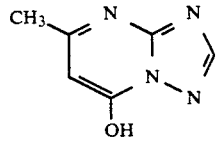

Cpd-13

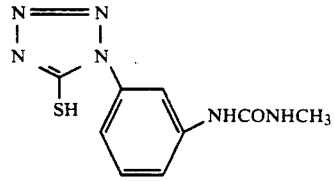

Cpd-14

Samples 102 to 113 were prepared in the same way as the above mentioned Sample 101 except that the magenta coupler and the high boiling point solvent in each layer in the above mentioned photosensitive material Sample 101 were changed, and polymers of this invention were added, as indicated in Table 1 below, and with the further exception that the solvent used in each of the 4th layer and 6th layer of Samples 107, 108, 111 and 112 was S-16 instead of (II-5).

The above mentioned photosensitive materials were given an imagewise exposure, after which they were processed continuously in accordance with the processing operation indicated below, using a Fujicolor Paper Processor PP600, until the system had been replenished to the extent of twice the volume of the color development tank, and continuous processing (running tests) were carried out in this way.

| Processing Operation | Temp. (°C.) | Time Min. | Time Sec. | Replenishment Rate* (ml) | Tank Capacity (Liters) |
|---|---|---|---|---|---|
| Color development | 38 | 1 | 40 | 290 | 17 |
| Bleach-fix | 33 | | 60 | 150 | 9 |
| Rinse (1) | 30–34 | | 20 | — | 4 |
| Rinse (2) | 30–34 | | 20 | — | 4 |
| Rinse (3) | 30–34 | | 20 | 364 | 4 |
| Drying | 70–80 | | 50 | | 4 |

*Per square meter of photosensitive material.

(Three tank counter-flow system from rinse (3) to rinse (1)).

The composition of each processing bath was as indicated below.

| | Tank Soln. | Replenisher |
|---|---|---|
| Color Development Bath | | |
| Water | 800 ml | 800 ml |
| Diethylenetriamine penta-acetic acid | 1.0 l | 1.0 g |
| Nitrilotriacetic acid | 2.0 l | 2.0 g |
| 1-Hydroxyethylidene-1,1-diphosphonic acid | 2.0 l | 2.0 g |
| Benzyl alcohol | 16 ml | 22 ml |
| Diethyleneglycol | 10 ml | 10 ml |
| Sodium sulfite | 2.0 g | 2.5 g |
| Potassium bromide | 0.5 g | |
| Potassium carbonate | 30 g | 30 g |
| n-Ethyl-N-(β-methanesulfonamido-ethyl)-3-methyl-4-aminoaniline sulfate | 5.5 g | 7.5 g |

-continued

| | Tank Soln. | Replenisher |
|---|---|---|
| Hydroxylamine sulfate | 2.0 g | 2.5 g |
| Fluorescent whitener (Whitex4B, made by Sumitomo Chemicals) | 1.5 g | 2.0 g |
| Water to make up to | 1000 ml | 1000 ml |
| pH (25° C.) | 10.20 | 10.60 |
| Bleach-fix Bath | | |
| Water | 400 ml | 400 ml |
| Ammonium thiosulfate (70%) | 200 ml | 300 ml |
| Sodium sulfite | 20 g | 40 g |
| Ethylenediamine tetra-acetic acid, Fe(III) ammonium salt | 60 g | 120 g |
| Ethylenediamine tetra-acetic acid, disodium salt | 5 g | 10 g |
| Water to make up to | 1000 ml | 1000 ml |
| pH (25° C.) | 6.70 | 6.30 |

Rinse Bath

Ion exchanged water (Calcium and magnesium both not more than 3 ppm)

The improvements in heat fastness and light fastness of the processed Samples and in respect of magenta staining of the white background (M-staining) on storage after processing were evaluated in the ways indicated below.

Thus, the fractional reduction in density from an initial density of 1.5 on storing the samples for 7 days in the dark at 100° C. was used to represent heat fading and the fractional reduction in density from an initial value of 1.5 on storing for 7 days in a xenon fadometer (80,000 lux) was used to represent light fading. M-staining was evaluated in terms of the difference in magenta density of the white background (unexposed part) immediately after processing and after storing the samples for 7 days at 100° C. (Table 2)

TABLE 1

| Sample No. | Magenta Coupler G*2 | High Boiling Point Solvent B*1 | High Boiling Point Solvent G*2 | High Boiling Point Solvent R*3 | Polymer*4 B*1 | Polymer*4 G*2 | Polymer*4 R*3 | Remarks |
|---|---|---|---|---|---|---|---|---|
| 101 | m-1 | S-25 | S-16/S-8 | S-16 | — | — | — | Comparative Example |
| 102 | m-1 | II-5 | S-16/S-8 | II-8 | P-3 | — | P-3 | Comparative Example |
| 103 | m-1 | II-8 | S-16/S-8 | II-5 | P-57 | — | P-57 | Comparative Example |
| 104 | m-4 | II-8 | S-16/S-8 | II-5 | P-57 | — | P-57 | Comparative Example |
| 105 | I-1 | S-25 | S-16/S-8 | S-16 | — | — | — | Comparative Example |
| 106 | I-1 | S-25 | S-16/S-8 | II-8 | — | — | — | Comparative Example |
| 107 | I-1 | II-8 | S-16/S-8 | II-5 | P-3 | — | P-3 | This Invention |
| 108 | I-1 | II-8 | S-16/S-8 | II-5 | P-57 | — | P-57 | This Invention |
| 109 | I-3 | II-8 | S-16/S-8 | II-5 | P-57 | — | P-110 | This Invention |
| 110 | I-3 | II-31 | S-16/S-8 | III-2 | P-134 | — | P-134 | This Invention |
| 111 | I-1 | S-25 | S-16/S-8 | S-16 | P-57 | — | P-57 | Comparative Example |
| 112 | I-1 | S-16 | S-16/S-8 | S-16 | P-3 | — | P-3 | Comparative Example |
| 113 | I-1 | II-31 | II-31/S-8 | II-31 | P-57 | P-57 | P-57 | This |

TABLE 1-continued

| Sample No. | Magenta Coupler G*2 | High Boiling Point Solvent B*1 | G*2 | R*3 | Polymer*4 B*1 | G*2 | R*3 | Remarks |
|---|---|---|---|---|---|---|---|---|
| | | | | | | | | Invention |

*1Blue sensitive silver halide emulsion layer
*2Green sensitive silver halide emulsion layer
*3Red sensitive silver halide emulsion layer
*4The polymer was used in the following amounts:
1/7 (by weight) with respect to the coupler in the blue sensitive layer (B)
1/8 (by weight) with respect to the coupler in the green sensitive layer (G)
5/4 (by weight) with respect to the coupler in the red sensitive layer (R)
The symbols used for the additive in the Table are those used for the compounds given earlier as representative examples.

TABLE 2

| Sample | Layer | Colored Image Fastness 7 Days × 100° C. | 7 Days × Xenon | M-Stain 7 Days × 100° C. | Remarks |
|---|---|---|---|---|---|
| 101 | B | 5% | 21% | — | Comparative Example |
| | G | 5% | 45% | 0.08 | |
| | R | 38% | 28% | — | |
| 102 | B | 5% | 15% | — | Comparative Example |
| | G | 5% | 47% | 0.08 | |
| | R | 15% | 16% | — | |
| 103 | B | 5% | 12% | — | Comparative Example |
| | G | 6% | 45% | 0.09 | |
| | R | 14% | 18% | — | |
| 104 | B | 5% | 15% | — | Comparative Example |
| | G | 4% | 22% | 0.05 | |
| | R | 17% | 18% | — | |
| 105 | B | 6% | 20% | — | Comparative Example |
| | G | 4% | 18% | 0.09 | |
| | R | 36% | 27% | — | |
| 106 | B | 6% | 21% | — | Comparative Example |
| | G | 4% | 18% | 0.03 | |
| | R | 34% | 27% | — | |
| 107 | B | 6% | 16% | — | This Invention |
| | G | 4% | 18% | 0.02 | |
| | R | 14% | 18% | — | |
| 108 | B | 5% | 15% | — | This Invention |
| | G | 6% | 18% | 0.02 | |
| | R | 13% | 17% | — | |
| 109 | B | 6% | 15% | — | This Invention |
| | G | 6% | 16% | 0.02 | |
| | R | 12% | 17% | — | |
| 110 | B | 7% | 15% | — | This Invention |
| | G | 6% | 17% | 0.02 | |
| | R | 13% | 18% | — | |
| 111 | B | 7% | 17% | — | Comparative Example |
| | G | 5% | 17% | 0.11 | |
| | R | 14% | 18% | — | |
| 112 | B | 7% | 16% | — | Comparative Example |
| | G | 6% | 17% | 0.14 | |
| | R | 14% | 18% | — | |
| 113 | B | 7% | 15% | — | This Invention |
| | G | 6% | 16% | 0.01 | |
| | R | 13% | 17% | — | |

It is clear from Table 2 that, in comparison to the comparative examples outside the scope of this invention, the invention provided overall excellent results in respect of the storage properties of the image from both the point of view of the colored image fastness and from the point of view of staining. More precisely, the colored image fastness showed an excellent fading balance between the three colors yellow, magenta and cyan, a point which is great practical importance, and with little increase in staining.

EXAMPLE 2

Photosensitive materials 201 to 213 were prepared in the same way as in Example 1 except that the silver halide emulsions used in Example 1 were changed as indicated below.

Thus EM-1 and EM-2 were changed to EM-7, EM-3 and EM-4 were changed to EM-8, and EM-5 and EM-6 were changed to EM-9.

The emulsions used were as follows:

| Emulsion | Form | Average Grain Size (μm) | Br Content (mol %) | Variation Coefficient |
|---|---|---|---|---|
| EM-7 | Cubic | 0.85 | 0.6 | 0.10 |
| EM-8 | Cubic | 0.45 | 1.0 | 0.09 |
| EM-9 | Cubic | 0.34 | 1.8 | 0.10 |

Variation Coefficient = Standard deviation/average size

The above mentioned photosensitive materials were exposed through an optical wedge, after which they were processed in the way indicated below.

| Processing Operation | Temperature | Time |
|---|---|---|
| Color development | 35° C. | 45 seconds |
| Bleach-fix | 30–36° C. | 45 seconds |
| Stabilizer (1) | 30–37° C. | 20 seconds |
| Stabilizer (2) | 30–37° C. | 20 seconds |
| Stabilizer (3) | 30–37° C. | 20 seconds |
| Stabilizer (4) | 30–37° C. | 30 seconds |
| Drying | 70–85° C. | 60 seconds |

(Four tank counter-flow system from stabilizer (4) to stabilizer (1)

The composition of each processing bath was as indicated below.

| | |
|---|---|
| Color Development Bath | |
| Water | 800 ml |
| Diethylenetriamine penta-acetic acid | 2.0 g |
| Triethanolamine | 8.0 g |
| Sodium chloride | 1.4 g |
| Potassium carbonate | 25 g |
| N-Ethyl-N-(β-methanesulfonamidoethyl)-3-methyl-4-aminoaniline sulfate | 5.0 g |
| N,N-diethylhydroxylamine | 4.2 g |
| 5,6-Dihydroxybenzene-1,2,4-trisulfonic acid | 0.3 g |
| Fluorescent whitener (4,4-diamino-stilbene based | 2.0 g |
| Water to make up to | 1000 ml |
| pH (25° C.) | 10.10 |
| Bleach-fix Bath | |
| Water | 400 ml |
| Ammonium thiosulfate (70%) | 100 ml |
| Sodium sulfite | 18 g |
| Ethylenediamine tetra-acetic acid, Fe(III) ammonium salt | 55 g |
| Ethylenediamine tetra-acetic acid, disodium salt | 3 g |
| Glacial acetic acid | 8 g |
| Water to make up to | 1000 ml |
| pH (25° C.) | 5.5 |
| Stabilizer Bath | |
| Formalin (37%) | 0.1 g |
| Formalin/sulfurous acid adduct | 0.7 g |
| 5-Chloro-2-methyl-4-isothiazolin-3-one | 0.02 g |

-continued

| | |
|---|---|
| 2-Methyl-4-isothiazolin-3-one | 0.01 g |
| Copper sulfate | 0.005 g |
| Water to make up to | 1000 ml |
| pH (25° C.) | 4.0 |

The coating emulsions or each layer were prepared as is disclosed in a case of, for example, material 102.

The coating emulsion for red sensitive layer was prepared by dissolving the cyan couplers (C-4) and (C-5), and (II-5) and (P-57) together with ethylacetate, dispersing the solution to aqueous gelatin solution to form a dispersion, and then adding the emulsion EM5 and EM6 to form a coating emulsion for red sensitive layer.

The coating emulsion for blue sensitive layer was prepared by dissolving the yellow coupler (Y-2), and (II-8) and (P-57) together with ethylacetate and processing in the same way as in the coating emulsion of red sensitive layer.

The coating emulsion for green sensitive layer was prepared by dissolving the magenta coupler (I-1) into the solvents thereof (S-16) and (S-8) and processing in the same way as in the coating emulsion of red sensitive layer.

The processed Samples so obtained were evaluated in the same way as in Example 1 and the results obtained were more or less the same as those shown in Table 2.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon a plurality of photographic constituting layers comprising a light-insensitive hydrophilic colloid layer, a magenta dye-forming coupler-containing silver halide emulsion layer, a magenta dye-forming coupler containing silver halide emulsion layer and a yellow dye-forming coupler-containing silver halide emulsion layer, wherein said magenta dye-forming coupler is incorporated into a green-sensitive silver halide emulsion layer and is represented by formula (I-2) or (I-3) below, a water insoluble but organic solvent soluble polymer is incorporated in at least one of said silver halide emulsion layers, said polymer being a homopolymer or copolymer comprised of repeating units having

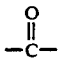

group in the main chain or in a side chain, an aliphatic ester solvent represented by the formula (II) or (III) below is incorporated in at least one of said light-insensitive hydrophilic colloid layer and said silver halide emulsion layers, and said silver halide emulsion layers contain a silver chlorobromide emulsion having from 90 mol % or more of silver chloride content,

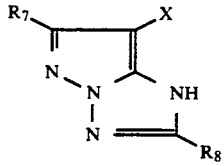

(I-2)

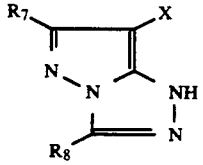

(I-3)

wherein $R_7$ and $R_8$ represent a hydrogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acrylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group and X represents a hydrogen atom, halogen atom, carboxyl group or a group which is eliminated on coupling, being a group which is bonded to the carbon at the coupling position via an oxygen atom, nitrogen atom or sulfur atom, $$R_2-(COOR_3)_m \quad \text{(II)}$$

$$(R_4COO)_n-R_5 \quad \text{(III)}$$

wherein $R_2$ and $R_5$ represent an alkylidene group, an alkylene group, an alkenylene group, an alkanetriyl group, an alkenetriyl group, an alkane tetrayl group, an alkenetetrayl group, an alkanepentayl group, or an alkenepentayl group, $R_3$ and $R_4$ represent an alkyl group, an alkenyl group or an alkynyl group which has not more than 20 carbon atoms, and m and n represent integer values of from 2 to 5.

2. A silver halide photographic material as in claim 1, wherein the water insoluble, organic solvent soluble homopolymer or copolymer is selected from a homopolymer or copolymer in which the repeating unit has a

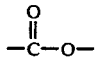

group in the main chain or in a side chain, and a homopolymer or copolymer in which the repeating unit has a

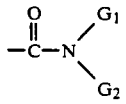

group in a side chain, where $G_1$ and $G_2$ each represent a hydrogen atom, or a substituted or unsubstituted alkyl or aryl group, but no more than one of $G_1$ and $G_2$ represent a hydrogen atom.

3. A silver halide photographic material as in claim 1, wherein said silver halide emulsion layers contain a silver chlorobromide emulsion having from a of silver chloride content of at least 98 mol %.

4. A silver halide photographic material as in claim 1, wherein said silver halide emulsion layers contain a monodisperse emulsion having 15% or less of coefficient of variation.

5. A silver halide color photographic material as in claim 1, wherein said material is produced by a process involving dissolving said coupler and polymer in a high-boiling coupler solvent and an auxiliary organic solvent to form a solution; emulsifying or dispersing said solution in a water or an aqueous solution of a hydrophilic colloid to form particles; dispersing said particles in said at least one silver halide emulsion layer.

6. A silver halide color photographic material as in claim 1, wherein the mixing ratio of the coupler to the polymer in the silver halide emulsion layer containing the polymer is from 1:20 to 20:1 by weight.

7. A silver halide color photographic material as in claim 1, wherein the mixing ratio of the coupler to the polymer in the silver halide emulsion layer containing the polymer is from 1:10 to 10:1 by weight.

8. A silver halide photographic material as in claim 1, wherein said coupler is represented by formula (I-2).

9. A silver halide photographic material as in claim 1, wherein said magenta dye-forming coupler, said water insoluble but organic solvent soluble polymer and said aliphatic ester solvent are incorporated in the same layer or in a different layer.

10. A silver halide photographic material as in claim 1, wherein said magenta dye-forming coupler is incorporated in a green sensitive silver halide emulsion layer, said polymer is incorporated in a red sensitive silver halide emulsion layer and/or blue sensitive silver halide emulsion layer, and said aliphatic ester solvent is incorporated in a red sensitive silver halide emulsion layer and/or blue sensitive silver halide emulsion layer and/or light-insensitive hydrophilic colloid layer.

* * * * *